US005282346A

United States Patent [19]

Masuda et al.

[11] Patent Number: 5,282,346

[45] Date of Patent: Feb. 1, 1994

[54] UNWRAPPING APPARATUS WITH SWING ARMS AND GRIPPERS

[75] Inventors: Tadao Masuda, Tokyo; Masahiro Tsukuda, Takatsuki; Shigeru Doiura, Takatsuki; Kaoru Kawanishi, Takatsuki; Hiroshi Iwasaki, Tokyo; Katsumi Hayakawa, Takatsuki, all of Japan

[73] Assignee: Oji Seitai Kaisha, Ltd., Tokyo, Japan

[21] Appl. No.: 994,975

[22] Filed: Dec. 22, 1992

[30] Foreign Application Priority Data

May 14, 1992 [JP] Japan ..... 4-038581[U]
Jun. 24, 1992 [JP] Japan ..... 4-188935
Jul. 29, 1992 [JP] Japan ..... 4-058436[U]
Aug. 12, 1992 [JP] Japan ..... 4-061961[U]

[51] Int. Cl.[5] ..... B65B 13/04; B65B 43/26; B65B 63/04

[52] U.S. Cl. ..... 53/118; 53/375.9; 53/381.1; 53/381.2; 53/492; 53/587; 414/412

[58] Field of Search ..... 53/118, 375.9, 381.1, 53/381.2, 384.1, 556, 587, 492; 414/412

[56] References Cited

U.S. PATENT DOCUMENTS 5,148,651 9/1992 Masuda et al. ..... 53/381.2

FOREIGN PATENT DOCUMENTS 1511847 1/1970 Fed. Rep. of Germany ..... 53/381.1
111642 4/1989 Japan ..... 414/412

*Primary Examiner*—John Sipos
*Assistant Examiner*—Linda B. Johnson
*Attorney, Agent, or Firm*—Burns, Doane, Swecker & Mathis

[57] ABSTRACT

An unwrapping apparatus for unwrapping a palletized and stretch-wrapped load, including at the front side thereof lower grippers and upper grippers to grip the lower edge and upper edge of a stretchable film of the load, respectively, and a cutter unit for vertically cutting the stretchable film. The unwrapping apparatus includes at the rear side thereof a carriage having a platen to press the top of a load, a pair of swing arms carrying the upper grippers, and a pair of auxiliary film separating swing arms to separate the stretchable film from the rear corner portions of the load when the film is removed from the load by the main swing arms. The main swing arms and the auxiliary swing arms prevent the articles from being pulled and moved by the stretchable film in contact with the articles and thus falling down from the separate sheet in particular.

42 Claims, 30 Drawing Sheets

UNWRAPPING APPARATUS WITH SWING ARMS AND GRIPPERS

BACKGROUND OF THE INVENTION

1. Field of the Invention

The present invention relates to an unwrapping apparatus for unwrapping a stretch-wrapped load comprised of a pallet, a plurality of articles palletized on the pallet and a stretchable film wrapping the articles and the pallet together, and in particular, the present invention relates to an improved unwrapping apparatus for unwrapping a stretch-wrapped load by cutting a stretchable film of the stretch-wrapped load and removing it without shrinkage of the stretchable film until the film is completely separated from the palletized articles.

2. Description of the Related Art

Conventionally, a variety of empty containers, such as glass bottles, PET bottles (polyethylene terephthalate bottles), or metallic cans are delivered to a bottling plant in the form of a load in which containers are placed on a pallet in bulk and layered via separate sheets between the layers, and the load is shrink wrapped or stretch wrapped using a stretchable film. Shrink wrapping apparatuses and stretch wrapping apparatuses that can automatically shrink wrap or stretch wrap empty containers are known.

The shrink wrapped or stretch-wrapped load must be unwrapped upon reaching a user. There are known unwrapping apparatuses for automatically unwrapping a shrink wrapped or stretch-wrapped palletized load and disclosed in, for example, the Japanese Unexamined Patent (Kokai) No. 48-58995, No. 49-95788, No. 1-111642, and No. 2-166033.

However, when a shrink wrapped or stretch-wrapped palletized load is unwrapped, which includes light and empty containers placed on a pallet in bulk and layered via separate sheets, containers i.e., the wrapped articles sometimes fall off the separate sheets, because in stretch wrapping, the elastic stretchable film is generally horizontally wound around the articles under tension and enter any gaps between the vertically adjacent separate sheets so as to be in contact with the articles, and when the stretchable film is cut in this condition, the stretchable film suddenly shrinks owing to an immediate tension release of the stretchable film maintained in contact with the surfaces of the articles, resulting in the articles comprising light and empty containers stacked in bulk via separate sheets being pulled and moved by the stretchable film and possibly falling from the separate sheets In addition, when the cut stretchable film is removed from the load, sudden shrinkage of the stretchable film may occur owing to an immediate tension release at a location where the stretchable film contacts the articles, resulting in a similar situation. It is known from experience that the above described phenomenon occurs most frequently at the uppermost four corners of the stretch-wrapped load.

The unwrapping apparatuses described in the above Patent Publications do not have an appropriate means to solve this problem and are not adapted for unwrapping the stretch-wrapped load in which light and empty containers are placed in bulk on a pallet and layered via separate sheets.

Further, these unwrapping apparatuses do not have means to compress and compact the stretchable film that is cut and removed from the unwrapping apparatus so as to facilitate step thereby disposing of the stretchable film, and additional manpower is necessary to dispose of the bulky stretchable film.

To solve the above described problems, Japanese Patent Application No. 3-27726 (and the corresponding U.S. patent application Ser. No. 771,629, now U.S. Pat. No. 5,148,651) assigned to the same assignee as the present case discloses an unwrapping apparatus that prevents shrinkage of the stretchable film contacting the wrapped articles, whereby, when the load is unwrapped, the wrapped articles, such as empty containers contacting the stretchable film, are prevented from being pulled and moved by the stretchable film and thus falling down from the separate sheets (in particular, the uppermost four corners of the load), and the stretchable film is compressed and compacted after removing said film from the load.

However, even in the unwrapping apparatus disclosed in the above described Japanese Patent Application No. 3-27726, if very light empty containers such as PET bottles are wrapped by a relatively highly tacky stretchable film, the wrapped empty containers at the uppermost rear corners (viewed in the unwrapping apparatus) of the stretch-wrapped load rarely fall down when the load is unwrapped.

SUMMARY OF THE INVENTION

The object of the present invention is to provide an unwrapping apparatus by which, when a stretch-wrapped load comprised of a plurality of articles, such as very light empty containers, stacked on a pallet in bulk via separate sheets is unwrapped, it is possible to efficiently prevent the wrapped articles from falling.

According to the present invention, there is provided an unwrapping apparatus for unwrapping a load comprised of a pallet, a plurality of articles pelletized on the pallet and a stretchable film wrapping the articles and the pallet together; said unwrapping apparatus comprising first and second upright frames arranged in a spaced relationship, means for conveying a load to be unwrapped to a position between the first and the second upright frames, lower gripper means arranged on or near the first upright frame for gripping a lower edge of a stretchable film of a load to be unwrapped, a cutter unit arranged on the first upright frame for upward and downward movement along the first upright frame for vertically cutting the stretchable film, a carriage arranged on the second upright frame for upward and downward movement along the second upright frame and having pressing means to press down on the top of the load to be unwrapped so as to stabilize the load while being unwrapped, a pair of swing arms symmetrically arranged on either side of the pressing means with pivot ends on the side of the second upright frame and free ends on the side of the first upright frame, an upper gripper arranged on the free end of each of the swing arms for gripping an upper edge of the stretchable film of the load, whereby the stretchable film that is cut by the cutter unit and gripped by the upper grippers is spread and separated from the load during a swing motion of the swing arms, and a pair of auxiliary film separating means operable in synchronism with the movement of the swing arms for engagement with corner portions of the stretchable film on the side of the second upright frame to separate the stretchable film from the corner portions of the load.

With this arrangement, the pressing means is first actuated to press down on the top of the stretch-wrapped load to stabilize the same, and the lower gripper means is then actuated to grip the lower edge of the stretchable film of the load and in this position the cutter unit moves upwards to cut the stretchable film from the lower edge to the upper edge. The cutter unit is momentarily stopped at a position near the upper edge of the stretchable film and then moves upwards again to cut the remaining portion of the stretchable film after the upper gripper means grips the upper edge of the stretchable film.

In this way, according to the present invention, the stretchable film is gripped by the lower gripper means or both the lower and upper gripper means from the start of the cutting to the end of the cutting, thereby preventing the stretchable film from shrinking during the cutting.

When the stretchable film is fully cut, the upper gripper means moves upwards and the lower gripper means releases the lower edge of the stretchable film. Simultaneously the swing arms carrying the upper gripper means starts to swing and spread the severed stretchable film to either side of the cutting line. The swing motion of the swing arms are accompanied by the forward extension of the upper gripper means (i.e., the upper gripper means advances), thereby preventing the stretchable film from shrinking owing to a release of tension during the opening motion of the swing arms and removing the stretchable film from the palletized load.

The auxiliary film separating means is operated at an appropriate time before the swing arms are fully opened and inserted in a gap between the wrapped articles of the load and the stretchable film so as to engage with the stretchable film converting the corner portion of the load on the side of the second upright frame and separate the stretchable film from the corner portion of the load.

In this way, according to the present invention, it is possible to effectively prevent wrapped articles, such as empty containers (especially at the uppermost four corners of the load) from falling by preventing shrinkage of the stretchable film in contact with the articles, and by separating the stretchable film during the opening process from the wrapped articles prior to final separation of the cut stretchable film by the main swing arms.

Preferably, each of the auxiliary film separating means comprises a auxiliary swing arm having a length shorter than that of the swing arms, and a vertically retractable pin carried by the auxiliary swing arm. In this case, the auxiliary swing arm is carried by the support frame of the carriage via a rotary actuator, and the retractable pin is carried by the auxiliary swing arm via a vertical pneumatic cylinder. Preferably, the rotary actuator comprises a rotary pneumatic actuator operable within a predetermined angular range of at least 90 degrees.

BRIEF DESCRIPTION OF THE DRAWINGS

The other objects and features of the present invention will become apparent from the following description of the preferred embodiments as non-limitative examples, with reference to the accompanying drawings, in which.

DESCRIPTION OF THE PREFERRED EMBODIMENTS

Figure 1:
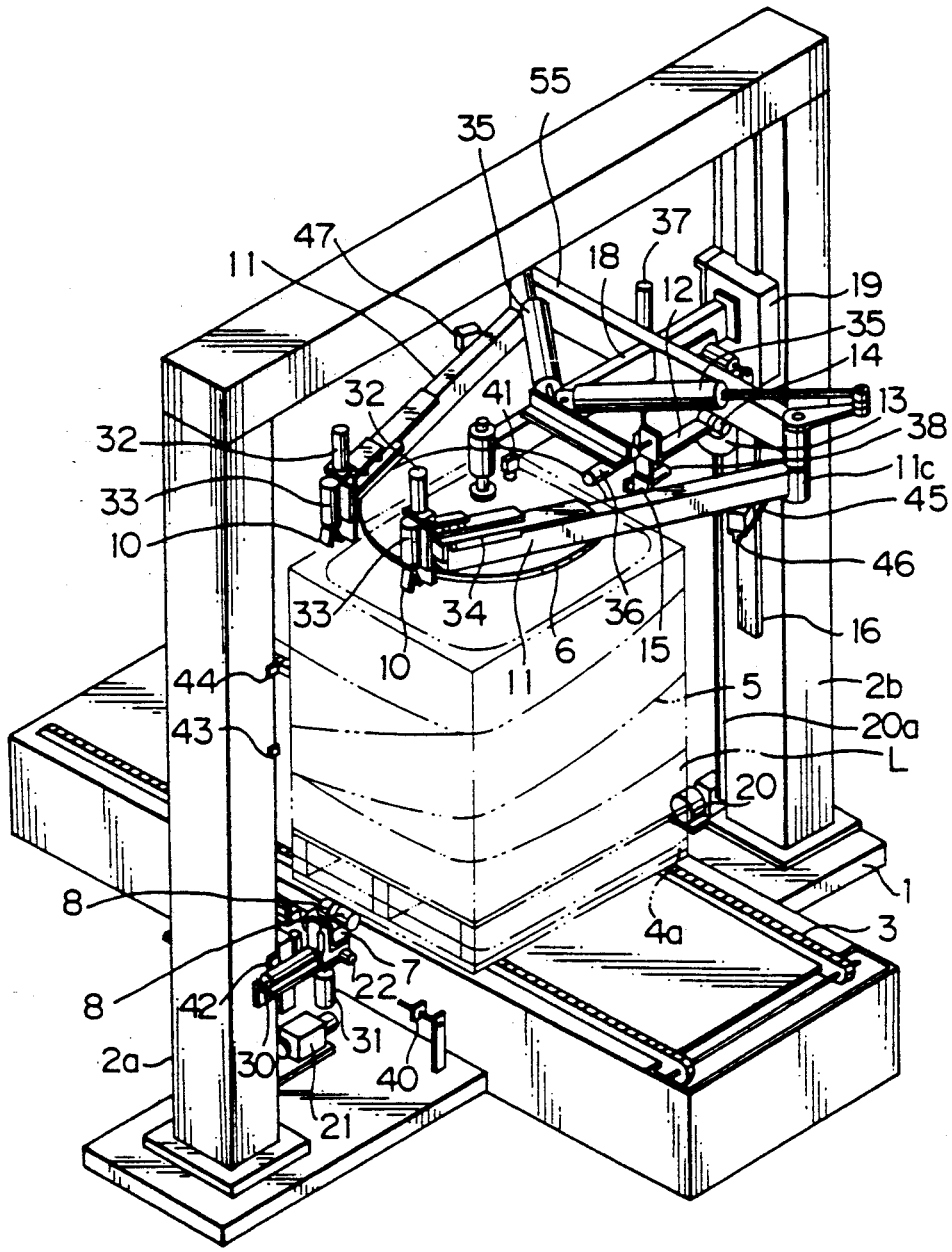
FIG. 1 is a perspective view of an unwrapping apparatus according to the first embodiment of the present invention.
Figure 2:
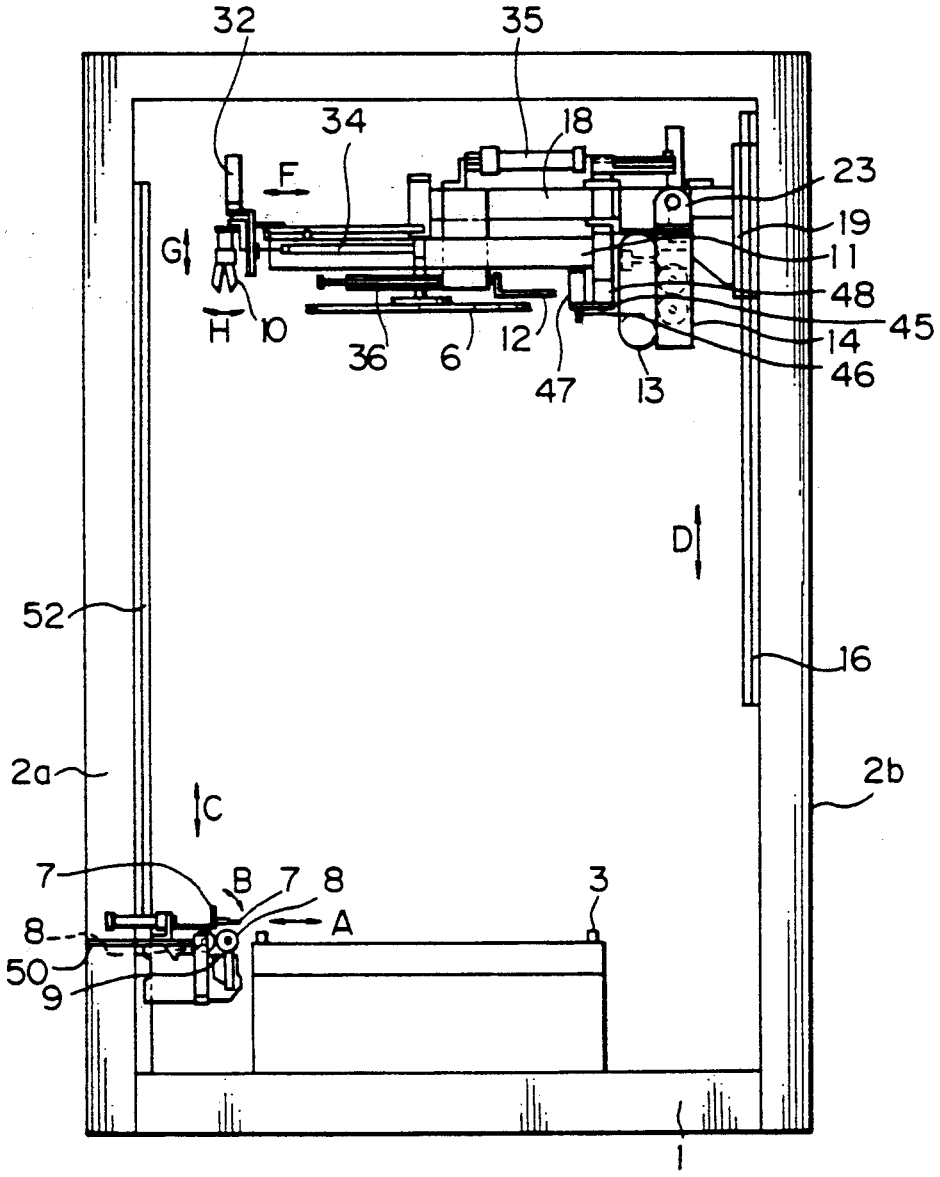
FIG. 2 is a side view of the unwrapping apparatus of FIG. 1.
Figure 11:
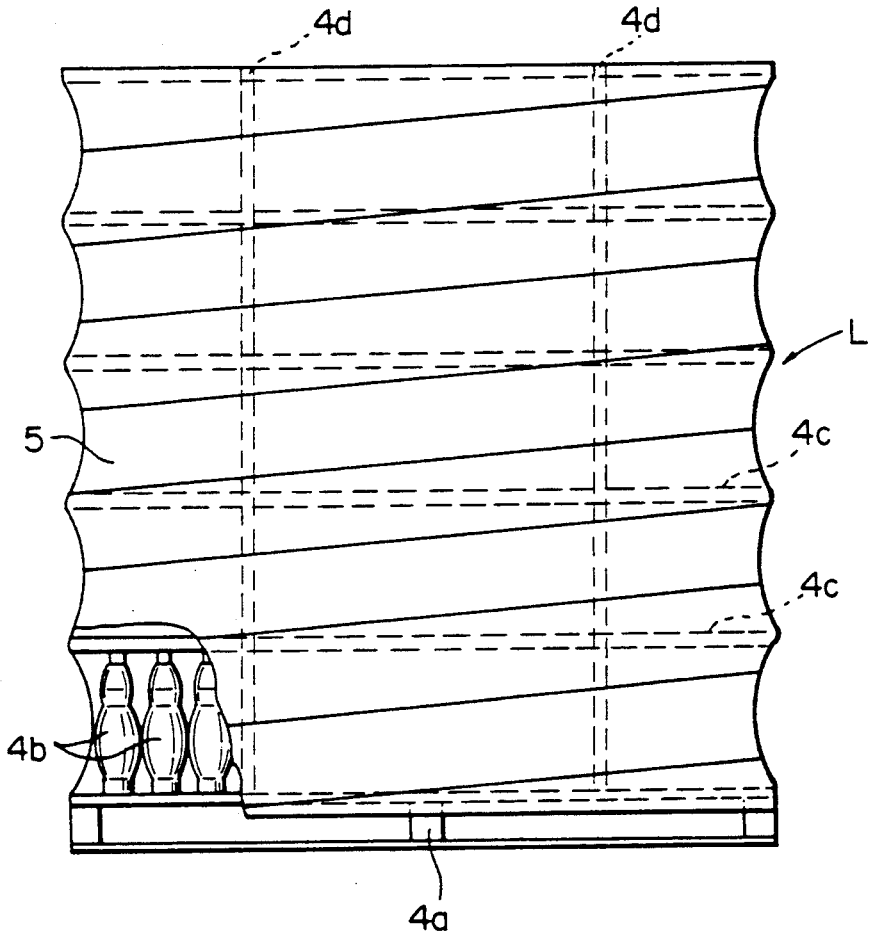
FIG. 11 is a side view of an example of a palletized and stretch-wrapped load.

FIG. 1 is an overall perspective view of an unwrapping apparatus according to the present invention and FIG. 2 is its elevational side view. The unwrapping apparatus is adapted to unwrap a palletized and stretch-wrapped load L, such as that shown in FIG. 11. In FIG. 11, the load L is comprised of a pallet 4*a*, a plurality of articles 4*b* palletized on the pallet 4*a* and a stretchable film 5 wrapping the articles 4*b* and the pallet 4*a* together. In this example, the articles 4*b* are empty PET bottles which are placed on the pallet 4*a* in bulk via separate sheets 4*c*. Straps 4*d* are applied to the load L before the stretchable film 5 is applied. The stretchable film 5 includes plural layers encircling the articles 4*b* in tension, and may contact the articles 4*b* at the peripheral regions of the stretch-wrapped load L. The stretchable film 5 may enter any gaps or cavities between the separate sheets 4*c* or between the pallet 4*a* and the bottom separate sheet 4*c* and shows a concave profile, as shown in FIG. 11. Such a palletized and stretch-wrapped load L can be transported to a user, such as a bottling plant, and unwrapped there.

Referring to FIGS. 1 and 2, the unwrapping apparatus includes a base frame 1, a first front upright frame 2*a* and a second rear upright frame 2*b*. A chain conveyor 3 is provided on the base frame 1 for conveying the stretch-wrapped load L to a position between the first and second upright frames 2*a* and 2*b*. Of course, the other conveying means such as a roller conveyor or an autoguided vehicle can be used. A platen 6 as a pressing means is provided to press a top central region of the palletized load L to stabilize the latter during unwrapping.

Figure 4:
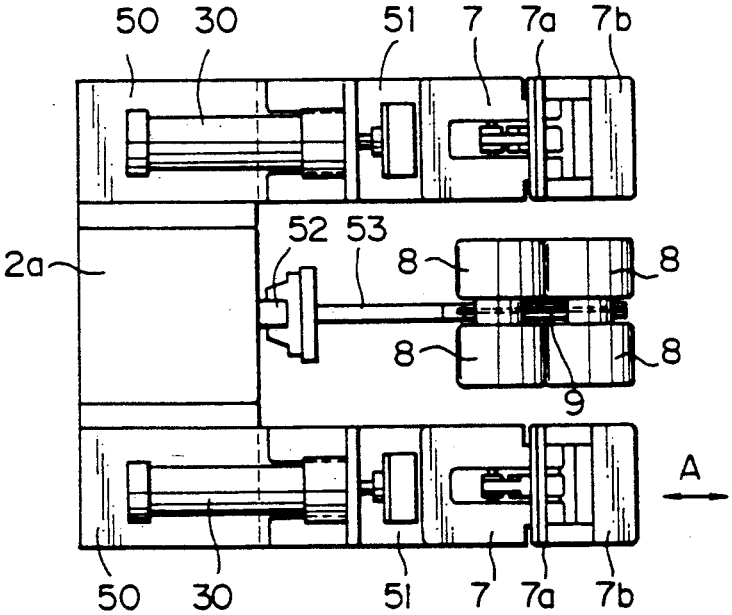
FIG. 4 is a plan view of a cutter unit and lower grippers mounted on first upright frame of the unwrapping apparatus of FIGS. 1 and 2.
Figure 5:
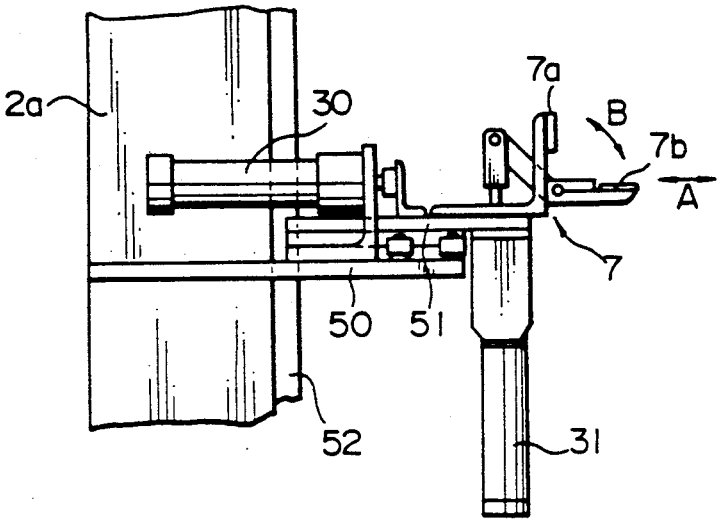
FIG. 5 is a side view of the lower grippers.

As shown in FIGS. 1 and 2, and particularly in FIGS. 4 and 5, the first upright frame 2*a* has lower gripper brackets 50 attached at a lower portion of the first upright frame 2*a* on either side thereof. Slidable brackets 51 are positioned on the lower gripper brackets 50, respectively, and secure lower grippers 7 thereon, respectively, so that the lower grippers 7 with the slidable brackets 51 are movable toward and away from the load L, as shown by the arrow A. Pneumatic cylinders 30 are provided to move the slidable brackets 51, respectively. Each of the lower grippers 7 has a vertical stationary jaw 7*a* and a movable jaw 7*b*, as shown in FIG. 5. The movable jaw 7*b* is moved toward and away from the stationary jaw 7*a* for the gripping action by a pneumatic cylinder 31, as shown by the arrow B.

Figure 6:
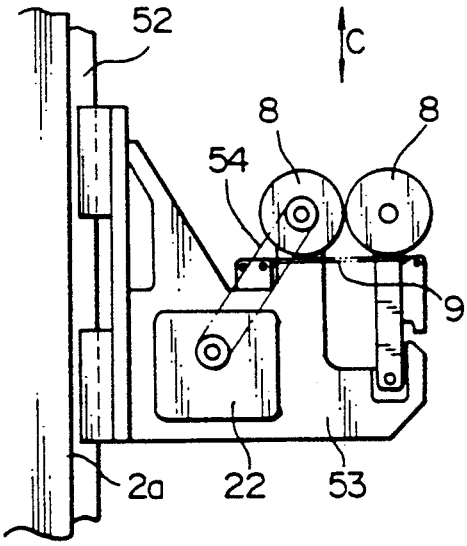
FIG. 6 is a side view of the cutter unit.

The first upright frame 2*a* also has a vertical slide guide 52 at the inner side thereof facing the second upright frame 2*b*. A cutter unit slider 53 is engaged with the vertical slide guide 52 for upward and downward movement along the first upright frame 2*a*, as shown by the arrow C. An electric motor 21 moves the cutter unit slider 53 upwards and downwards along the vertical slide guide 52 via a chain or the like (not shown). The cutter unit slider 53 supports two pairs of pinch rollers 8 and an electric heat cutter 9 adapted to cut the stretchable film 5. As shown in FIGS. 4 and 6, the heat cutter 9 extends between the two lower grippers 7 toward the palletized load L, and the two pairs of pinch rollers 8 are arranged on either side of the heat cutter 9, and just above the heat cutter 9. As shown in FIG. 4, the pinch rollers 8 of each pair contact each other and the contact surface between the pinch rollers 8 of each pair extends generally on a line passing through the vertical plane of the stationary jaws 7*a* of the lower grippers 7. Since the lower grippers 7 grip the lower edge of the stretchable film 5 of the stretch-wrapped load L with the stretchable film 5 rested against the stationary jaws 7*a*, it will be understood that one of each pair of pinch rollers 8 is positionable on the exterior side of the stretchable film 5 of the stretch-wrapped load L, and the other on the interior side of the stretchable film 5 to grip the stretchable film 5 therebetween. An electric motor 22 drives (or rotates) the pinch rollers 8 via a belt 54.

Figure 3:
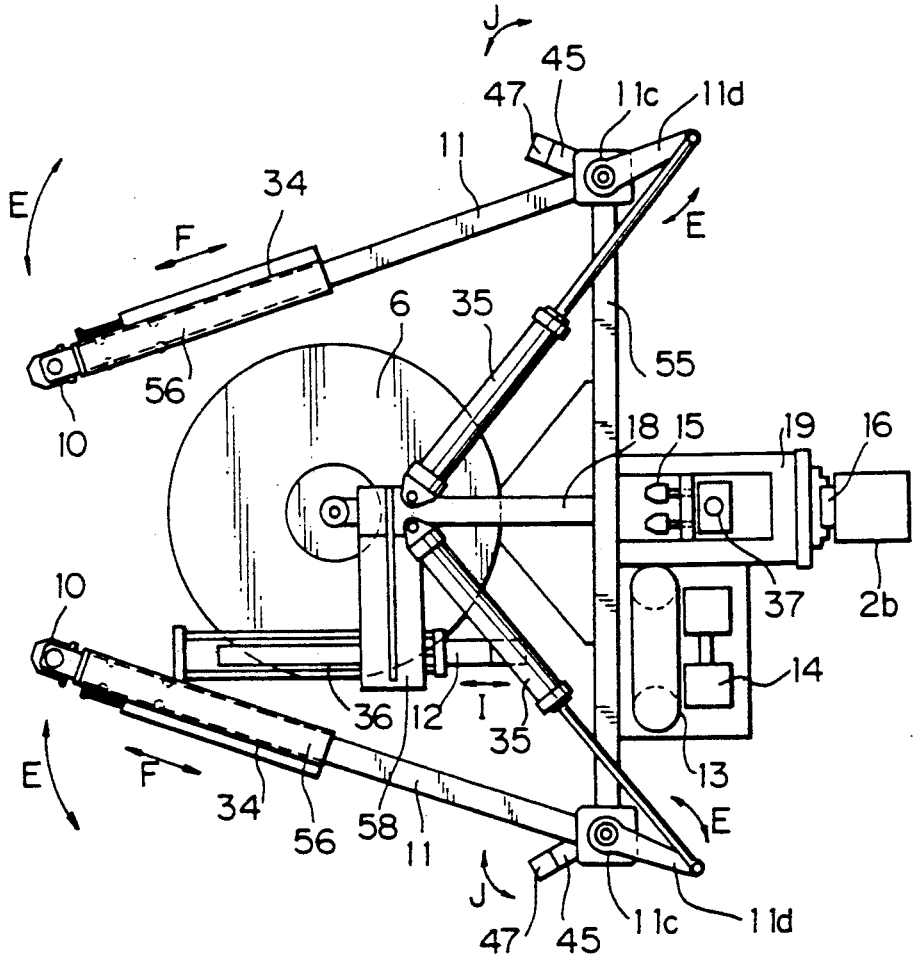
FIG. 3 is a plan view of a carriage mounted on a second upright frame of the unwrapping apparatus of FIGS. 1 and 2.

As shown in FIGS. 1 to 3, the second upright frame 2*b* has a vertical slide guide 16 at the inner side thereof facing the first upright frame 2*a*. A carriage 19 is engaged with the vertical slide guide 16 for upward and downward movement along the second upright frame 2*b*, as shown by the arrow D. An electric motor 20 moves the carriage 19 upwards and downwards via a chain or a belt 20*a*. The carriage 19 has a swing arm support frame 55 fixed to the free end of the carriage 19 and a platen arm 18 extending from the central position of the swing arm support frame 55. The platen arm 18 supports the platen 6. The swing arm support frame 55 horizontally extends perpendicular to a plane including the first and the second upright frames 2*a* and 2*b* and is located at such a position that the swing arm support frame 55 is slightly behind the stretch-wrapped load L to be unwrapped, as shown in FIG. 1. The length of the swing arm support frame 55 is slightly larger than one side of the stretch-wrapped load L.

A pair of main swing arms 11 are pivotally mounted, respectively, on either end of the swing arm support frame 55 by pivots 11C and symmetrically arranged on either side of the platen 6. The main swing arms 11 extend from the swing arm support frame 55 toward the first upright frame 2*a* and have respective pivot ends 11C and free ends provided with upper grippers 10 having movable jaws 10*a* and 10*b*, respectively, for gripping an upper edge of the stretchable film 5 of the stretch-wrapped load L to be unwrapped. Pneumatic cylinders 35 having marketable proportional flow control valves and pivot levers 11*d* are associated with the main swing arms 11, respectively, to cause the main swing arms 11 to swing relative to the swing arm support frame 55, as shown by the arrow E. Note, by employing marketable proportional control valves for the pneumatic cylinders 35 instead of electro-magnetic valves of conventional ON-OFF type, it is possible not only to infinitely adjust the speed of the swing motion (constant rotational speed) of the main swing arms 11, but also to change the speed during the swing motion of the main swing arms 11, as desired, for cooperation with the swing motion of the auxiliary swing arms 45. It is also possible to instantaneously stop the swing motion of the main swing arms 11 as desired.

Figure 7:
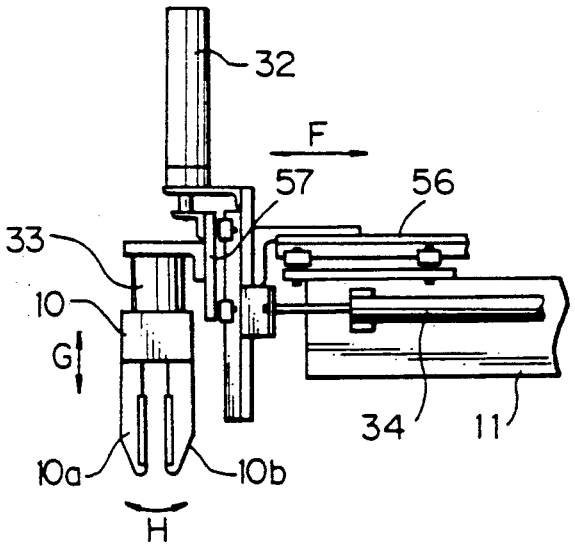
FIG. 7 is a side view of the upper grippers.

As shown in FIG. 2, 3 and 7, each of the upper grippers 10 is attached to the respective main swing arm 11 via a slidable gripper plate 56 and a slidable elevator plate 57, and thus movable toward and away from the stretch-wrapped load L, as shown by the arrow F, and upward and downward, as shown by the arrow G. Pneumatic cylinders 34 are associated with the slidable gripper plates 56, and pneumatic cylinders 32 are associated with the elevator plate 57, for this purpose. The upper gripper 10 is attached to the slidable elevator plate 57 by a pneumatic cylinder 33 and a rack and pinion which opens and closes the movable jaws 10*a* and 10*b* of the upper gripper 10 for a gripping action, as shown by the arrow H.

Figure 8A:
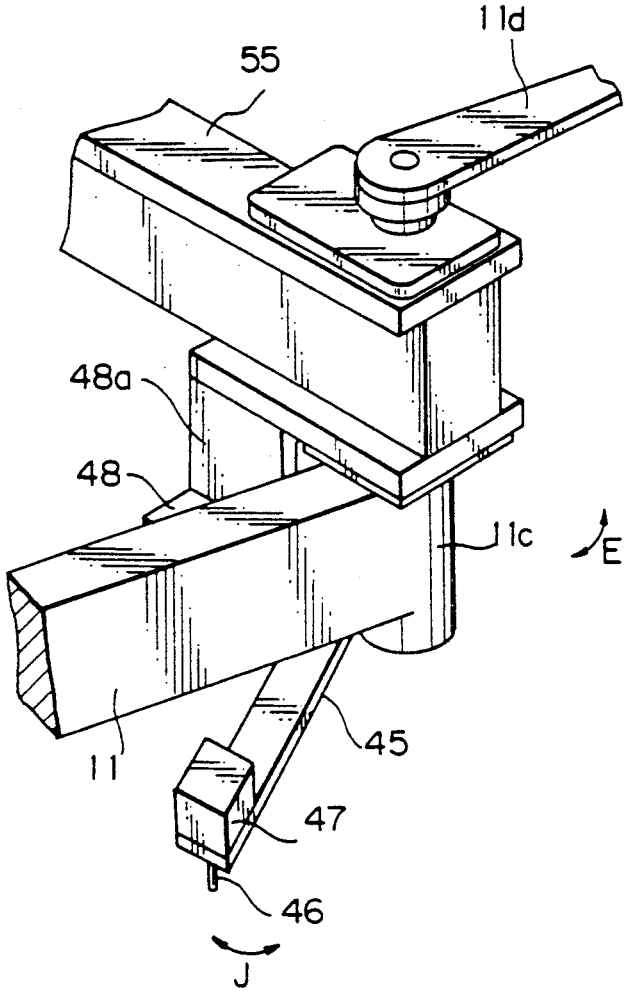
FIGS. 8A and 8B are perspective views of a portion of a main swing arm and a auxiliary film separating means including a auxiliary swing arm.
Figure 8B:
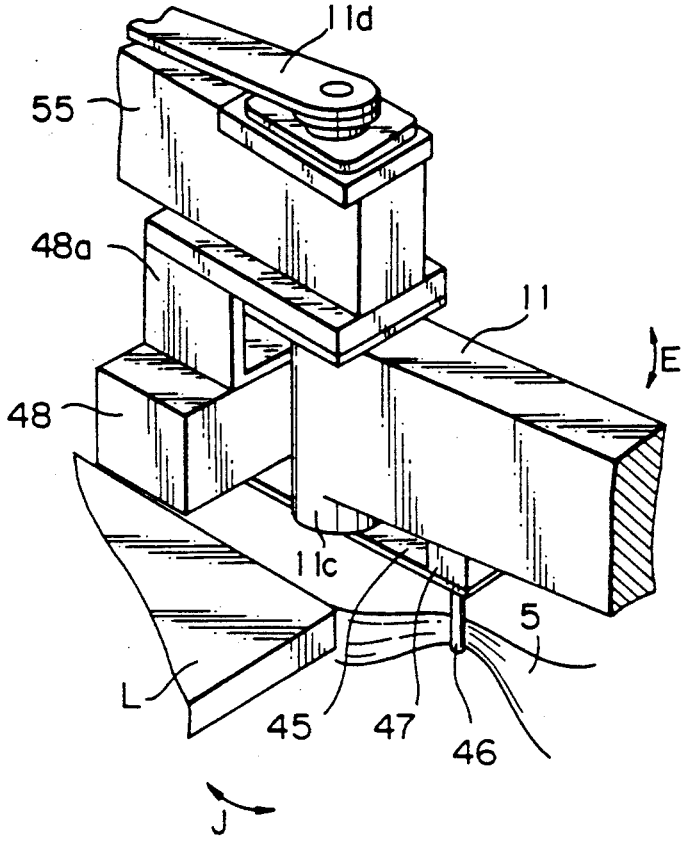
Figure 8C:
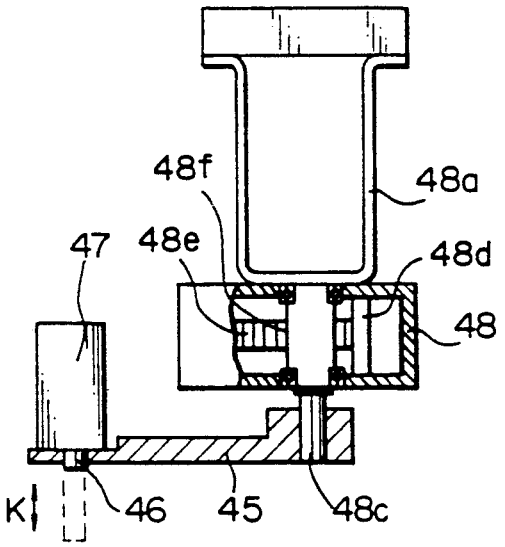
FIG. 8C is a partially cross-sectional side view of the auxiliary film separating means.

As shown in FIGS. 1, 3, and 8A to 8C, a pair of auxiliary film separating means are pivotally provided on the swing arm support frame 55 near the pivot 11*c* of the main swing arms 11. As best seen in FIGS. 8A to 8C, each of the auxiliary film separating means comprises a auxiliary swing arm 45 having a length shorter than that of the main swing arm 11 and a vertically retractable pin 46 carried by the auxiliary swing arm 45. A bracket 48*a* is attached to the bottom of the swing arm support frame 55 inboard of the pivot 11*c* of the main swing arms 11, and a pneumatic rotary actuator 48 is supported by the bracket 48*a*. The pneumatic rotary actuator 48 includes a vertically arranged rotatable shaft 48*c* that carries the auxiliary swing arm 45. The pneumatic rotary actuator 48 can be a commercially available actuator that may include a pneumatically actuated and horizontally reciprocable piston 48*d* and a mechanism such as a rack-and-pinion mechanism 48*e*–48*f* for transmitting the linear motion of the piston to the rotational motion of the rotatable shaft 48*c*, whereby the auxiliary swing arm 45 can swing within a predetermined angular range of at least 90 degrees, as shown by the arrow J. The pin 46 is attached to a piston of the pneumatic cylinder 47, which is fixed to the swing arm support frame 55, and the pin 46 is vertically retractable and extendable, as shown by the arrow K.

The auxiliary swing arm 45 and the pin 46 are arranged to engage two corner portions of the stretchable film 5 on the rear side thereof, i.e., on the side of the second upright frame 2*b* to separate the stretchable film 5 from the corner portion of the load L.

Further, a pusher bracket 58 extends perpendicularly from the platen arm 18 and supports a horizontal pneumatic cylinder 36 that has a piston rod securing a pusher 12. The pusher 12 is arranged below the swing arm support frame 55 and is movable toward and away from the swing arm support frame 55, as shown by the arrow I in FIG. 3. The carriage 19 also has a ring-like collecting guide 13 arranged in alignment with the pusher 12. The collecting guide 13 has a circular or a trumpet-shaped opening into which the pusher 12 can be inserted. The pusher 12 forces the stretchable film 5 into the collecting guide 13 as soon as the stretchable film 5 is cut and separated from the palletized load L. The collecting guide 13 thus collectively guides the used stretchable film 5. In addition, a pair of discharge nip rollers 14 are arranged on the outlet side of the collecting guide 13 to continuously compress and discharge the stretchable film 5.

Further, an impulse heatsealer 15 is provided in the carriage 19. The carriage 19 supports a vertical pneumatic cylinder 37 having a piston rod which in turn carries a horizontal pneumatic cylinder 38. The heatsealer 15 is carried by the piston rod of the horizontal pneumatic cylinder 38. Therefore, the heatsealer 15 can be moved upwards and downwards, and toward and away from the stretch-wrapped load L. As shown in FIGS. 1 and 3, the heatsealer 15 is located at such a position that it can engages with the rear side of the stretch-wrapped load L, to heatseal and join together the plurality of layers of the stretchable film 5. If a top cover is provided on the load L, the heatsealer 15 can join the top cover and the stretchable film 5, to unitize them together to discharge them through the pusher 12, the collecting guide 13 and the discharge nip rollers 14.

Further sensors 40 to 44 are provided for detecting the positions of the stretch-wrapped load L and the other elements. The sensors 40 to 44 comprises, for example, beam switches or limit switches. The sensor 40 detects that the stretch-wrapped load L reaches a predetermined unwrapping position between the first and the second upright frames 2*a* and 2*b*. The sensor 41 detects that the platen 6 presses the stretch-wrapped load L. The sensor 42 detects that the cutter unit slider 53 is at a predetermined lower position and the sensor 43 detects that the cutter unit slider 53 is below and near the top of the stretch-wrapped load L. The sensor 44 detects that the cutter unit slider 53 moves above the top of the stretch-wrapped load L.

In operation, the palletized and stretch-wrapped load L is conveyed to the predetermined unwrapping position between the first and the second upright frames 2*a* and 2*b* by the conveyor 3 and stopped there by the output signal of the sensor 40. When the stretch-wrapped load L reaches this position, the lower grippers 7 and the cutter unit slider 53 are waiting in the position of FIG. 2, i.e., the latter just below the former. The carriage 19 supporting the platen 6, the upper grippers 10, the main swing arms 11 and the auxiliary swing arms 45 are in the position of FIGS. 2 and 3 above the load L.

When the stretch-wrapped load L is stopped at the predetermined position, the carriage 19 is moved downwards together with the platen 6 to press the top of the stretch-wrapped load L, and is stopped by the output signal of the sensor 41. The upper grippers 10 and the pins 46 are simultaneously lowered but stopped just above the upper edge of the stretch-wrapped load L.

Figure 9A:
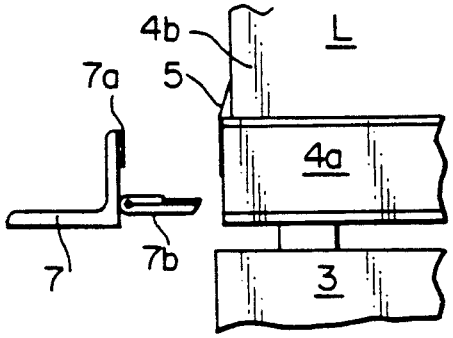
FIGS. 9A to 9D are side views illustrating the operation of the lower grippers.
Figure 9B:
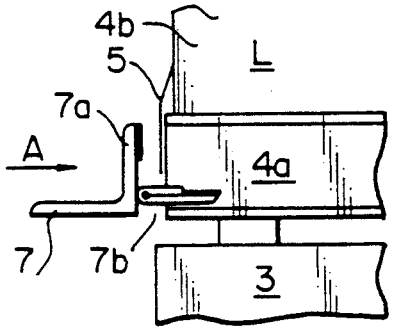
Figure 9C:
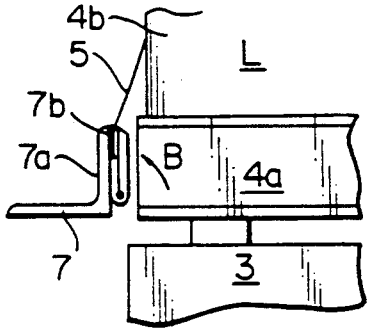
Figure 9D:
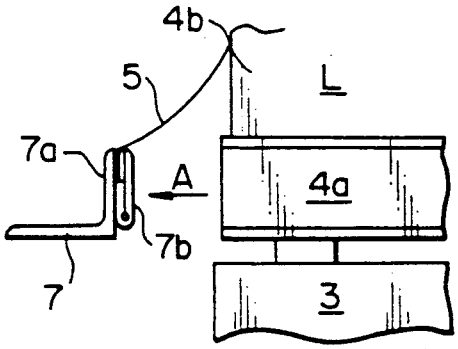

The movable jaws 7*b* of the lower grippers 7 are initially in the horizontal positions, as shown in FIGS. 5 and 9A. The lower grippers 7 are first moved toward and beyond the lower edge of the stretchable film 5, as shown in FIG. 9B. Then the movable jaws 7*b* of the lower grippers 7 are operated to grip the stretchable film 5 between the movable jaws 7*b* and the stationary jaws 7*a*, as shown in FIG. 9C. Then the lower grippers 7 are moved away from the lower portion of the palletized load L, as shown in FIG. 9D. Thus a lower portion of the stretchable film 5 is pulled out and separated from the articles 4*b* or the pallet 4*a* to make a gap between the lower portion of the stretchable film 5 and the articles 4*b* or the pallet 4*a*.

Then the pinch rollers 8 start to rotate and the cutter unit slider 53 is moved upwards along the first upright frame 2*a*. Thus the pinch rollers 8 pinch the stretchable film 5 from the exterior side and the interior side thereof and the heat cutter 9 starts cutting the stretchable film 5. Note, the cutter unit slider 53 is set at a position spaced apart from the stretch-wrapped load L and moves along a path designed so that the pinch rollers 8 and the heat cutter 9 do not contact the articles 4*b* while the pinch rollers 8 pull out the stretchable film 5, which is initially in close contact with the articles 4*b*.

The cutter unit slider 53 is stopped by the output signal of the sensor 43 located near the top of the stretch-wrapped load L. Then the upper grippers 10 move downwards and are actuated to grip the upper edge of the stretchable film 5 at positions on the outsides of the pinch rollers 8, i.e., on the left and right sides of the pinch rollers, viewed from the front. Then the cutter unit slider 53 is restarted and again stopped in response to the output signal of the sensor 44 located above the top of the stretch-wrapped load L. Thus the stretchable film 5 is completely cut and separated along the cutting line to the left and to the right thereof. In this way, the stretchable film 5 is maintained in tension while the stretchable film 5 is cut since the lower grippers 7 are gripping the lower edge of the stretchable film 5 and the upper grippers 10 are gripping the upper edge of the stretchable film 5.

Figure 10A:
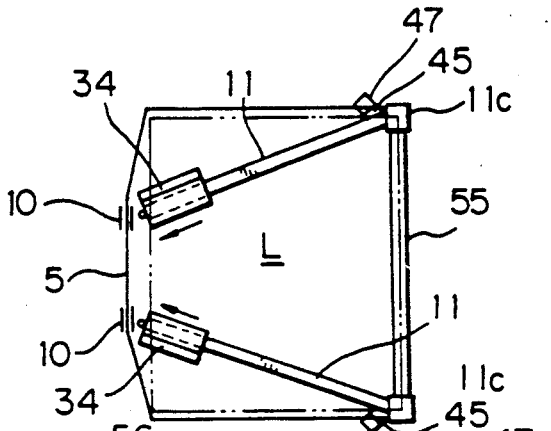
FIGS. 10A to 10F are plan views illustrating the operation of the upper grippers and swing arms.
Figure 10B:
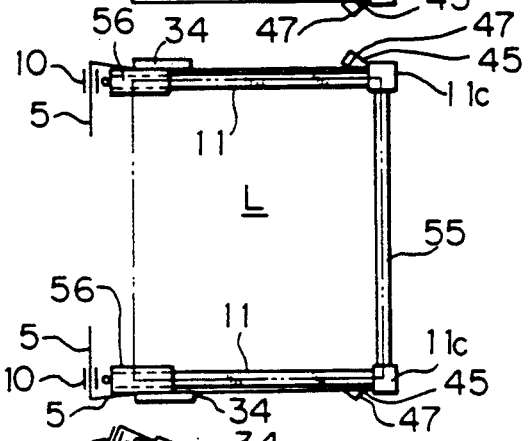
Figure 10C:
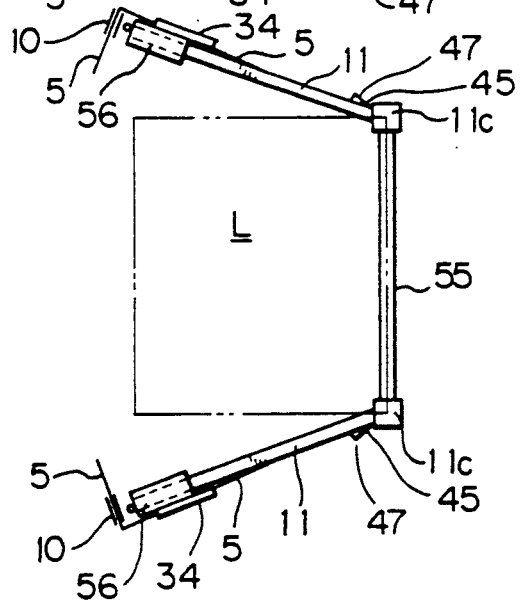
Figure 10D:
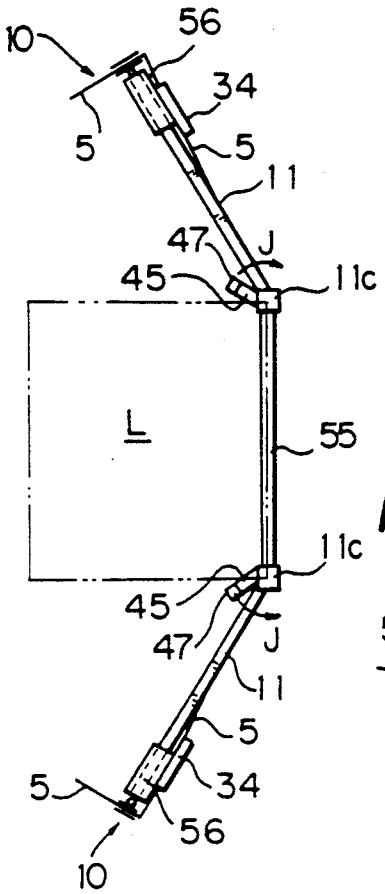
Figure 10E:
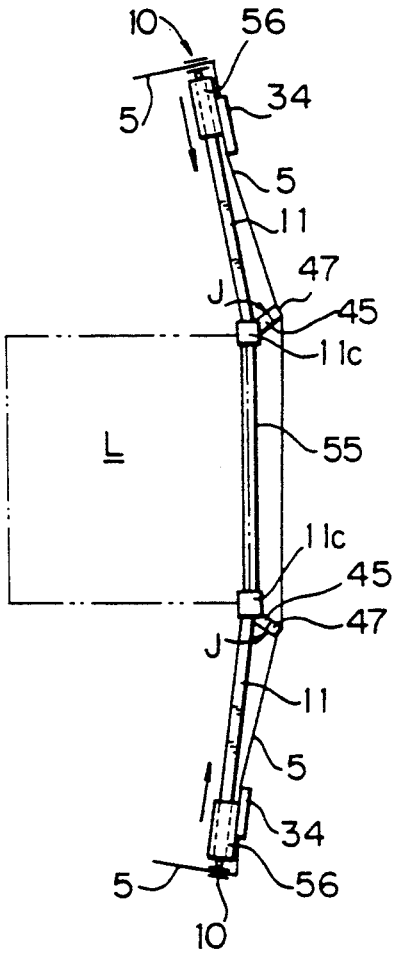
Figure 10F:
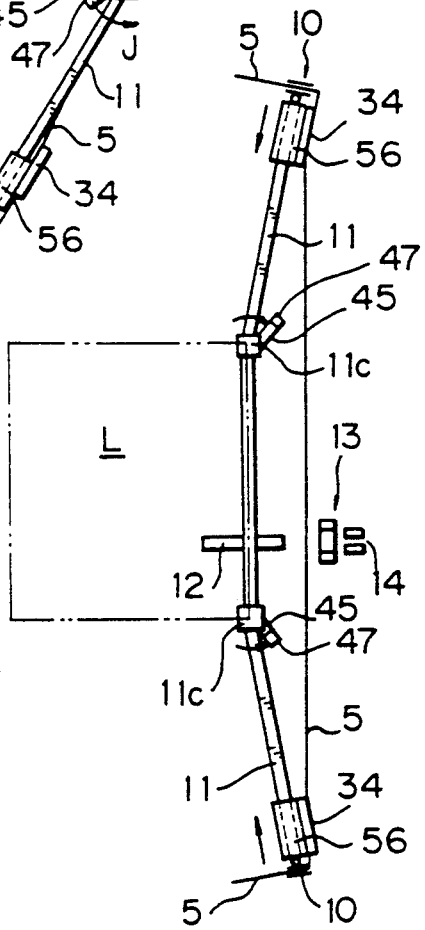

Finally, the lower grippers 7 release the lower edge of the stretchable film 5 and the upper grippers 10 move upwards with the actuation of the pneumatic cylinder 32. Simultaneously, the main swing arms 11 are spread from each other with the actuation of the pneumatic cylinders 35. Thus the severed vertical edges of the stretchable film 5 are laterally opened in the front side of the palletized load L (or articles **4*b*), and separated from the front side of the palletized load L, as shown in FIGS. 10A and 10B. In addition, the slidable gripper plate 56 supported at the free end of the main swing arms 11, and carrying the upper grippers 10, are extended with the actuation of the pneumatic cylinders 34. Therefore, the stretchable film 5 is stretched or pulled and maintained in tension so as not to allow the stretchable film 5 of any shrinkage while the stretchable film 5 is separated from the front side and the lateral sides of the load L, as shown in FIGS. 10B and 10C. The stretchable film 5 is maintained in tension without shrinkage until the swing arms 11 are finally swung to a position, as shown in FIG. 10F**.

The movement of the auxiliary swing arms 45 of the auxiliary film separating means is started an appropriate time after the movement of the main swing arms 11 is started. The main swing arms 11 are once stopped an appropriate time before the movement of the main swing arms 11 is completed, for example, at a time shown in FIG. 10D, in which each main swing arm 11 just extends beyond the pins 46 of the auxiliary film separating means. The pins 46 are first lowered with the actuation of the pneumatic cylinders 47 so that each pin 46 enters the gap between the side of the load and the upper edge of the stretchable film 5 near the rear corner portion thereof. The main swing arms 11 are then restarted to move and the auxiliary swing arms 45 are rotated as shown in FIGS. 10D to 10F. Note, the speed of the auxiliary swing arms 45 is higher than that of the main swing arms 11 and the auxiliary swing arms 45 are rotated more than 90 degrees. Accordingly, the pin 46 engages with the stretchable film 5 covering the corner portion of the load L to separate the stretchable film 5 from the corner portion of the load L, as shown in FIG. 8B, while the swing arms 11 are rotating and maintaining the tension in the stretchable film 5.

Preferably, the timing of the operation of the auxiliary swing arms 45 is such that the movement of the auxiliary swing arm 45 is completed before the movement of the main swing arms 11 is completed, as shown in FIG. 10E, that is, the main swing arms 11 travel beyond the line interconnecting the two rear corners of the load L after the auxiliary swing arm 45 travels beyond that line. The main swing arms 11 are then further moved to the final position of FIG. 10F, accompanying the retracting movement of the slidable gripper plate 56 relative to the main swing arms 11, and when the main swing arms 11 completely open, the stretchable film 5, the pins 46, the auxiliary swing arm 45 and the platen 6 are returned to their respective initial positions. It will be understood that the triggering of the pneumatic cylinders and rotary actuator can be modified from that as explained above.

In this way the stretchable film 5 is fully separated from the palletized load L (or the article **4*b*) without shrinkage. If the stretchable film 5 suddenly shrinks during removal, the articles 4*b* in contact with shrinking film 5 may be moved or shifted by the shrinking film and fall down out of the pallet 4*a* or the separate sheets 4*c*. According to the present invention, it is possible to prevent the articles 4*b*** from falling during unwrapping.

When the stretchable film 5 is fully separated from the palletized load L (or the palletized articles **4*b*), as shown in FIG. 10F, the pusher 12 is moved toward the stretchable film 5 supported by the upper grippers 10 to push it into the collecting guide 13 and the discharge nip rollers 14 may be driven. Then the upper grippers 10 release the stretchable film 5 that is being pulled into the collecting guide 13 and the discharge nip rollers 14. In this course, the stretchable film 5** is compressed or squeezed into a compact belt-like shape by which it can be easily disposed.

The stretch wrapped load L thus unwrapped is discharged by the conveyor 3 at an appropriate time after the end of the swing motion of the swing arms 11.

In the case of a load that is stretch wrapped after a further film (referred to as a top cover) covers the top of the load L, according to the unwrapping apparatus of the present invention, the impulse heatsealer 15 is lowered with the actuation of the pneumatic cylinder 37 and advanced toward the load L with the actuation of the pneumatic cylinder 38 so that the plural layers of the stretchable film 5 wound around the periphery of the load L and the top cover are heatsealed together to unitize them at an appropriate time during the time from the stopping of the load L conveyed by the conveyor 3 at the unwrapping position to the completion of the cutting of the stretchable film 5, thereby it is possible to consecutively compress the stretchable film 5, and the top cover and discharge them in a compact belt-like shape.

Figure 12:
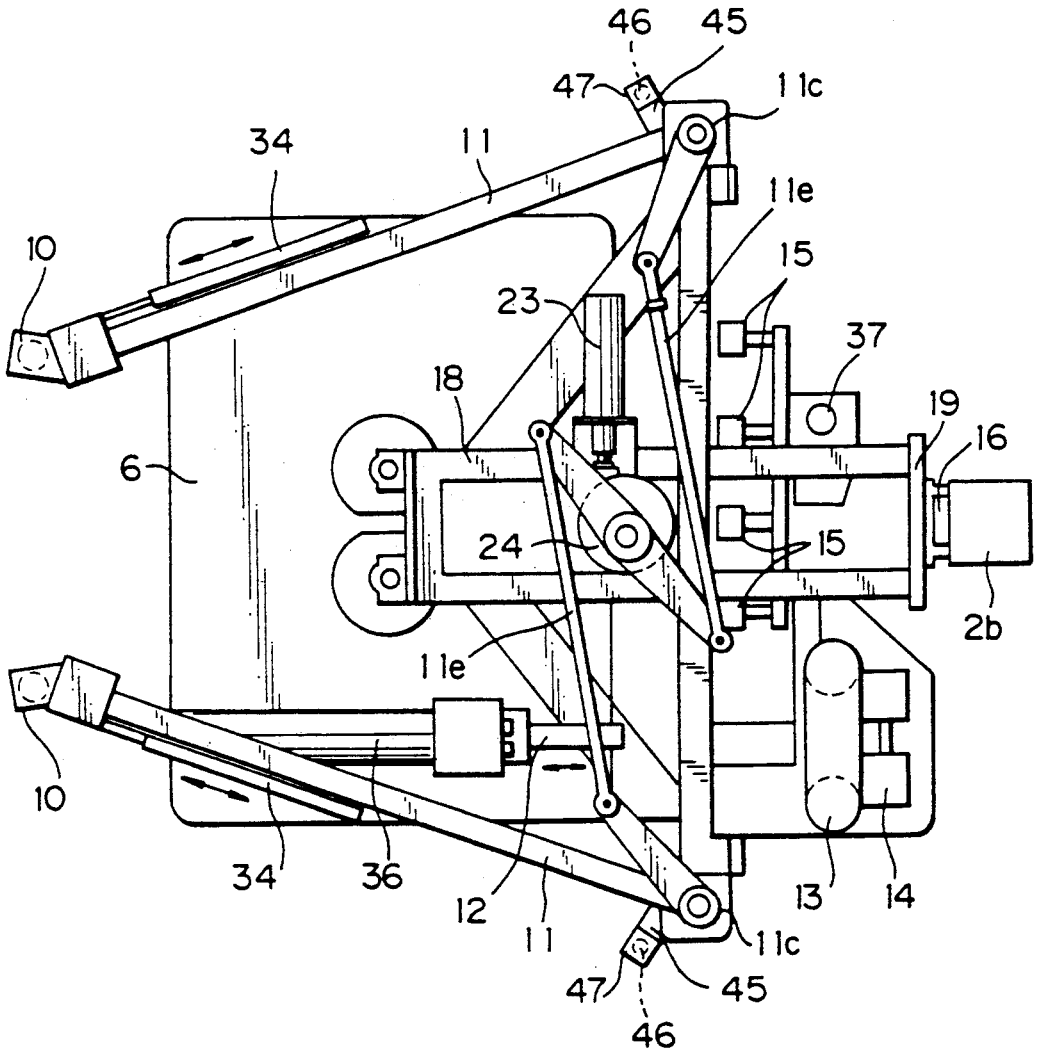
FIG. 12 is a plan view of a carriage mounted on a second upright frame of the unwrapping apparatus according to the second embodiment of the present invention.

FIG. 12 shows a carriage 19 according to the second embodiment of the present invention; the carriage 19 being mounted on the unwrapping apparatus of FIGS. 1 to 10F. The carriage 19 differs from that of FIGS. 1 to 10F in that it includes an electric servo motor 23, a reduction gear means 24 and pivot levers **11*e* for actuating the main swing arms 11, in place of the pneumatic cylinders 35** in the previous embodiment.

When a non-cling type film rather than a cling type film is used for the stretchable film 5, plural layers of the stretchable film 5 wound around the load L are not unitized to each other, and may be separated into individual layers when the stretchable film 5 is cut and then pushed into the ring-like collective guide 13 after unwrapping. Such separated stretchable film 5 may hinder the continuous operation of the unwrapping apparatus.

Figure 13:
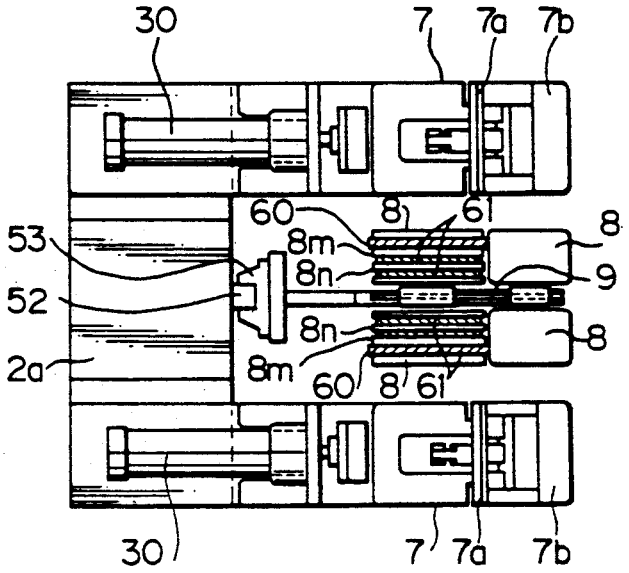
FIG. 13 is a plan of a cutter unit and lower grippers according to the third embodiment of the present invention.
Figure 14:
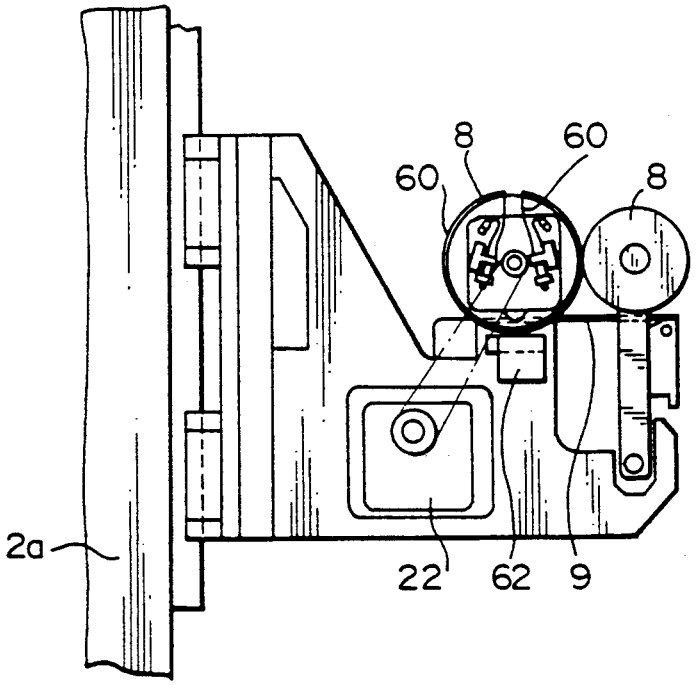
FIG. 14 is a side view of the cutter unit of FIG. 13.

The third embodiment of FIGS. 13 and 14 solves this problem. FIGS. 13 and 14 shown a cutter unit that can be mounted to the cutter unit slider 53 of the unwrapping apparatus of FIGS. 1 to 10F in place of the corresponding cutter of FIGS. 1 to 10F. In this embodiment, the cutter unit includes two pairs of nip rollers 8 and a heat cutter 9, and a heatsealer is incorporated in one of each pair of nip rollers 8 located on the exterior side of the stretchable film 5 to heatseal the stretchable film 5 continuously in two lines on either side of the cutting line of the stretchable film 5 to unitize the plural layers of strips of the stretchable film 5 together. In particular, as shown in FIGS. 13 and 14, the nip roller 8 on the exterior side of the stretchable film 5 comprises a combination of a plurality of different nylon disks to form a large diameter portion 8*m* and small diameter portions 8*n*. Nichrome wire 60 is arranged on the peripheral surface of the large diameter portion 8*m* and a layer of polytetrafluoroethylene covers the Nichrome wire 60. Slip rings 61 are arranged on the small diameter portions 8*n* for supplying the power to the Nichrome wire 60, and power supply contacts 62 are arranged below the nip roller 8 in contact with the slip rings 61. In addition, another roller on the interior side also comprises a nylon roller that is covered by a layer of silicon rubber and a layer of polytetrafluoroethylene.

In contrast to the above case, when a highly cling type film is used for the stretchable film 5, there may be the problem that the stretchable film 5 is not easily separated from the upper grippers 10 when the upper grippers 10 are opened to release the stretchable film 5 after the main swing arms 11 complete the opening of the severed stretchable film 5.

Figure 15:
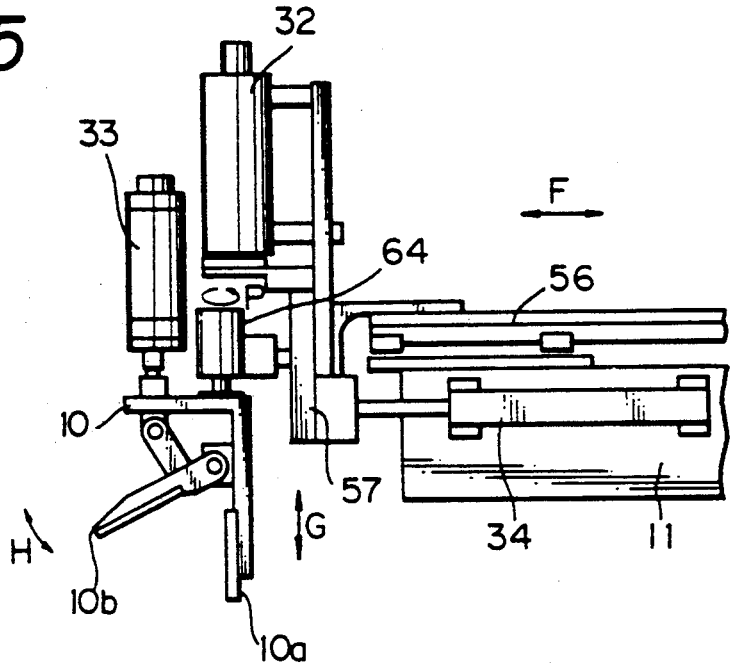
FIG. 15 is a side view of upper grippers according to the fourth embodiment of the present invention.
Figure 16:
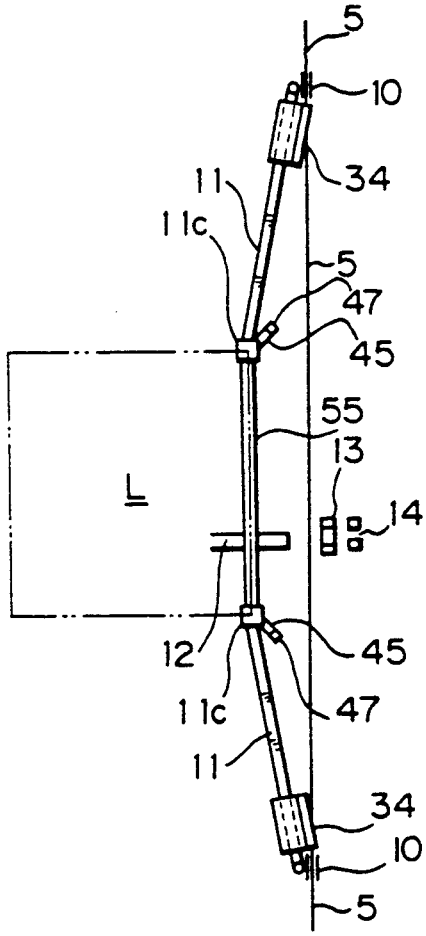
FIG. 16 is a plan view of swing arms with the upper grippers of FIG. 15 in a fully extended position.

The fourth embodiment of FIGS. 15 and 16 solves this problem. The upper grippers 10 in this embodiment are mounted to the slidable elevator plate 57 via a rotary support element 64; the slidable elevator plate 57 being connected to the respective swing arms 11 via the slidable gripper plate 56. The rotary support element 64 comprises a pneumatic rotary actuator similar to the pneumatic rotary actuator 58 and can rotate about a vertical axis, as shown by the arrow P. The upper grippers 10 are initially arranged at an angle relative to the respective swing arms 11, as shown in FIG. 10A, and the angle between the upper gripper 10 and the swing arm 11 is unchanged during the swing motion of the swing arms 11 (see FIG. 10F). The rotary support element 64 is operated to rotate the upper gripper 10 outwardly about the vertical axis at the free ends of the main swing arms 11 by approximately 90 degrees just after the main swing arms 11 complete the swing motion to open the stretchable film 5 so that the upper grippers 10 are directed generally parallel to the swing arms 11, as shown in FIG. 16. The stretchable film 5 thus assumes a straight position throughout its length, and is easily separated from the upper grippers 10 because of shrinkage when the upper grippers 10 are operated so as to open jaws 10*a* and 10*b*. Each of the upper grippers 10 comprises a stationary jaw 10*a* and a movable jaw 10*b*.

The articles such as empty containers 4*b* are light in weight and are layered so that the load L is frequently as high as approximately 2 meters, and when the load L reaches a user, the load L may not assume an exact upright position but may frequently be sightly inclined from the upright to either side. If the inclined load L is conveyed to the unwrapping position, there is the problem that the upper grippers 10, which are in the initial position, cannot accurately grip the upper edge of the stretchable film 5.

Figure 18:
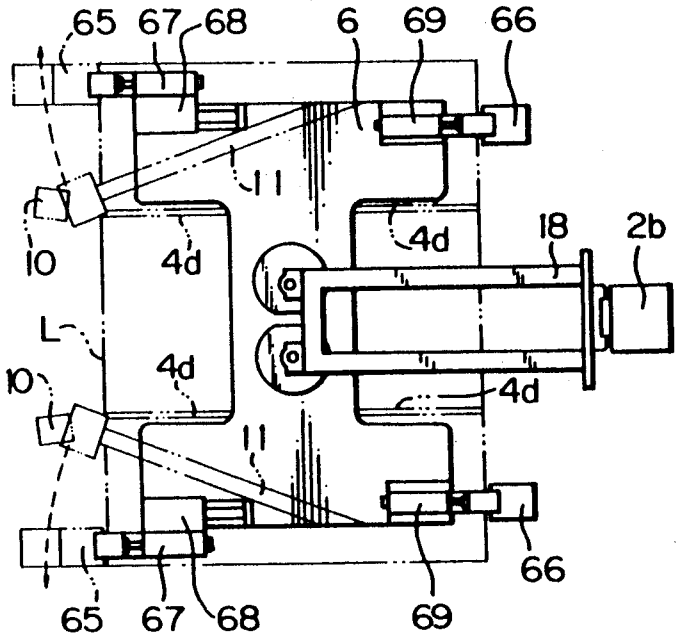
FIG. 18 is a plan view of a carriage of the unwrapping apparatus of FIG. 17.
Figure 17:
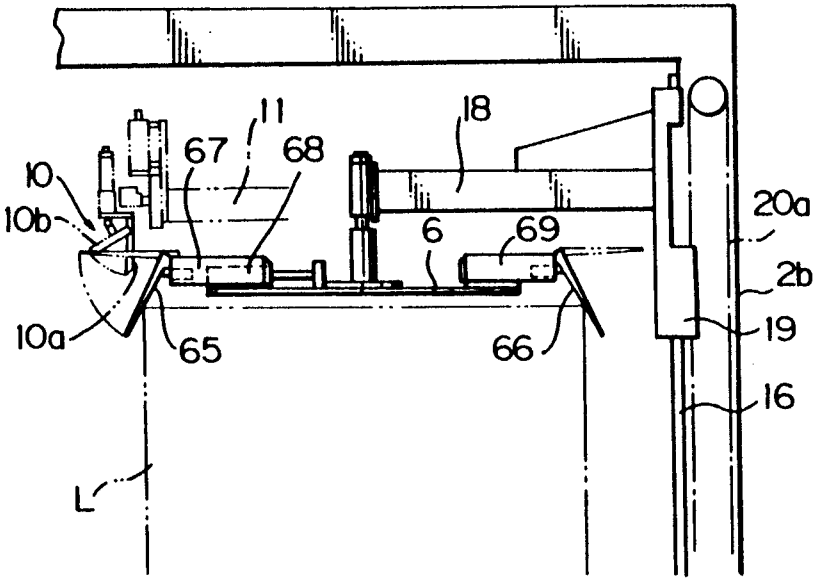
FIG. 17 is a side view of an unwrapping apparatus including position correcting levers according to the fifth embodiment of the present invention.
Figure 19:
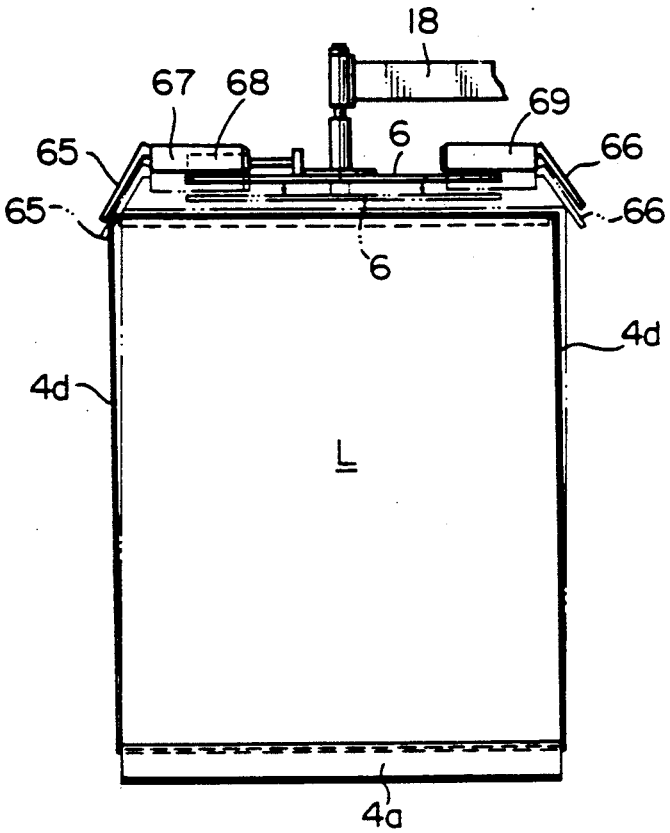
FIG. 19 is a diagrammatic side view of the unwrapping apparatus of FIGS. 17 and 18.

The fifth embodiment of FIGS. 17 to 19 solves this problem. In this embodiment, at least one position correcting means 65 or 66 is provided for engagement with an upper edge of the stretch-wrapped load L to correct the position of load L in relation to the position of the upper grippers 10. The position correcting means comprises at least a correcting guide 65 or 66 located above the load L.

In the preferred embodiment, two pairs of the correcting guides 65 and 66 are mounted to the platen 6, which is H-shaped. This platen 6 is modified from the circular one in FIG. 1. The correcting guides 65 are located at the front edges of the H-shaped platen 6 on the side of the first upright frame 2*a* and the other levers 66 are located at the rear edges of the H-shaped platen 6 on the side of the second upright frame. The front correcting guides 65 are mounted on the front lever tilting means 67 comprising plates pivotally securing the front correcting guides 65 and pneumatic cylinders causing the pivotal motion of the front correcting guides 65, respectively. The front lever tilting means 67 is supported on the platen 6 via front lever retracting pneumatic cylinders 68. The rear correcting guides 66 are mounted on the rear lever tilting means 69 also comprising plates pivotally securing the rear correcting guides 66 and pneumatic cylinders causing the pivotal motion of the rear correcting guides 66, respectively. The rear lever tilting means 69 is directly supported on the platen 6.

Accordingly, the correcting guides 65 and 66 are capable of moving from a first horizontal position on the outside of the load L (shown by the semi-broken line in FIG. 17) to a second downwardly tilted position toward the load L (shown by the solid line in FIG. 17) to thereby engage with an upper edge of the stretch-wrapped load L.

The front correcting guides 65 are initially in the first horizontal and retracted positions and the rear correcting guides 66 are initially in the first horizontal positions. When the load L reaches the unwrapping position, the front correcting guides 65 are advanced and moved from the first horizontal position to the second downwardly tilted position and the rear correcting guides 66 are moved from the first horizontal position to the second downwardly tilted position. The front and rear correcting guides 65 and 66 are lowered with the platen 6 to engage with the respective upper edges of the stretch-wrapped load L.

If the load L is in a precise upright position, the front and the rear correcting guides 65 and 66 simultaneously engage with the front and the rear upper edges of the load L, as shown in FIG. 17. If the load L is in the inclined upright position, any two of the front and the rear correcting guides 65 and 66 engage with the corresponding upper edges of the load L, as shown in FIG. 19. The upper edges of the load L in contact with the correcting guides 65 or 66 slide along the latter until the front and the rear upper edges of the load L engage with the front and the rear correcting guides 65 and 66 together. In this way, the position of the load L is corrected to the exact upright position in which the upper grippers 10 can grip the upper edge of the stretchable film 5 when the cutter unit reaches the predetermined height of the load L. The load L may include straps 4*d* (FIG. 19) that will get fit with the corrected load L.

When the continuously descending platen 6 approaches a position near the top of the load L, such as a position shown in FIG. 17, the front and rear correcting guides 65 and 66 are returned to the respective first horizontal positions and the front correcting guides 65 are retracted over the load L. The unwrapping operation is carried out in a manner previously described.

The main swing arms 11 can swing in a horizontal plane above the correcting guildes 65 and 66 without being interfered with by the latter, but the upper grippers 10 carried by the main swing arms 11 or the stretchable film gripped by the latter may be interfered with by the front correcting guides 65. Accordingly, the front correcting guides 65 are retracted.

Figure 20:
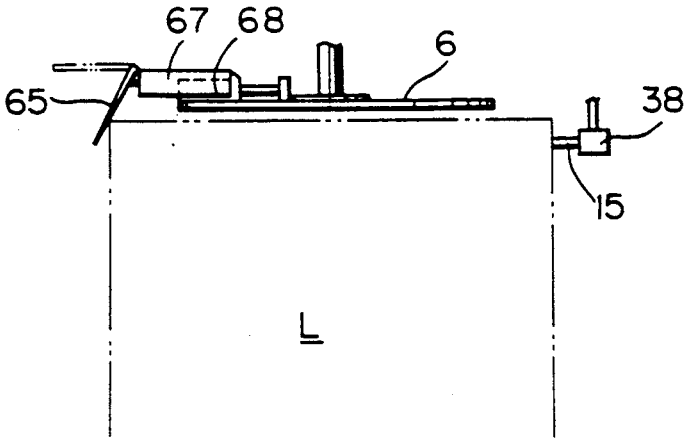
FIG. 20 is a diagrammatic side view of a modified unwrapping apparatus including position correcting levers.

FIG. 20 shows a modified unwrapping apparatus, including correcting guides. In this embodiment, the position correcting means comprises front correcting guides 65 similar to those in the previous embodiment, and a heatsealer 15 arranged on the rear side of the load L. This heatsealer 15 corresponds to that shown in FIG. 1 carried by the horizontal pneumatic cylinder 38, which is in turn carried by the vertical pneumatic cylinder 37. It will be understood that the heatsealer 15 can push the load L if the position of the load L is incorrect.

Figure 21:
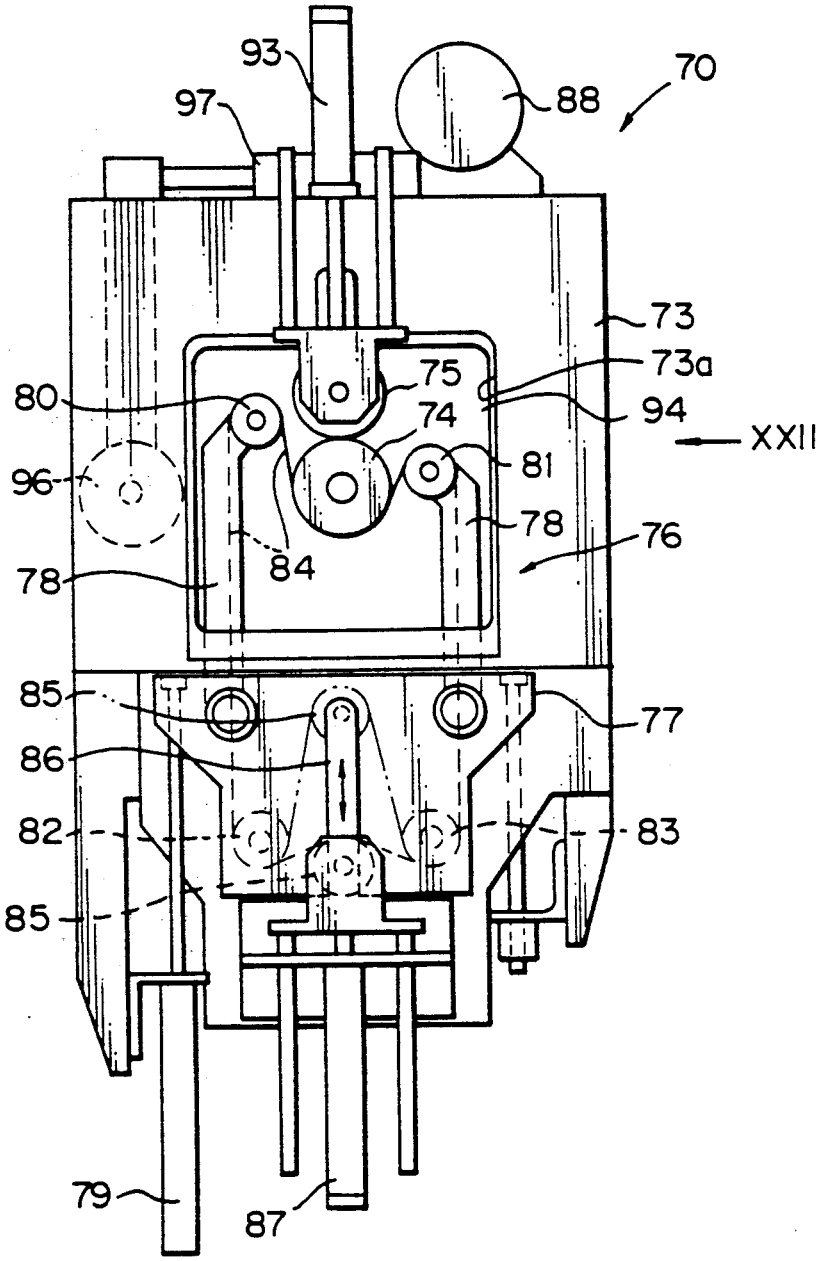
FIG. 21 is a side view of a used film winding unit adapted for use with the unwrapping apparatus of FIG. 1, for example, and viewed from the arrow XXI in FIG. 22.
Figure 22:
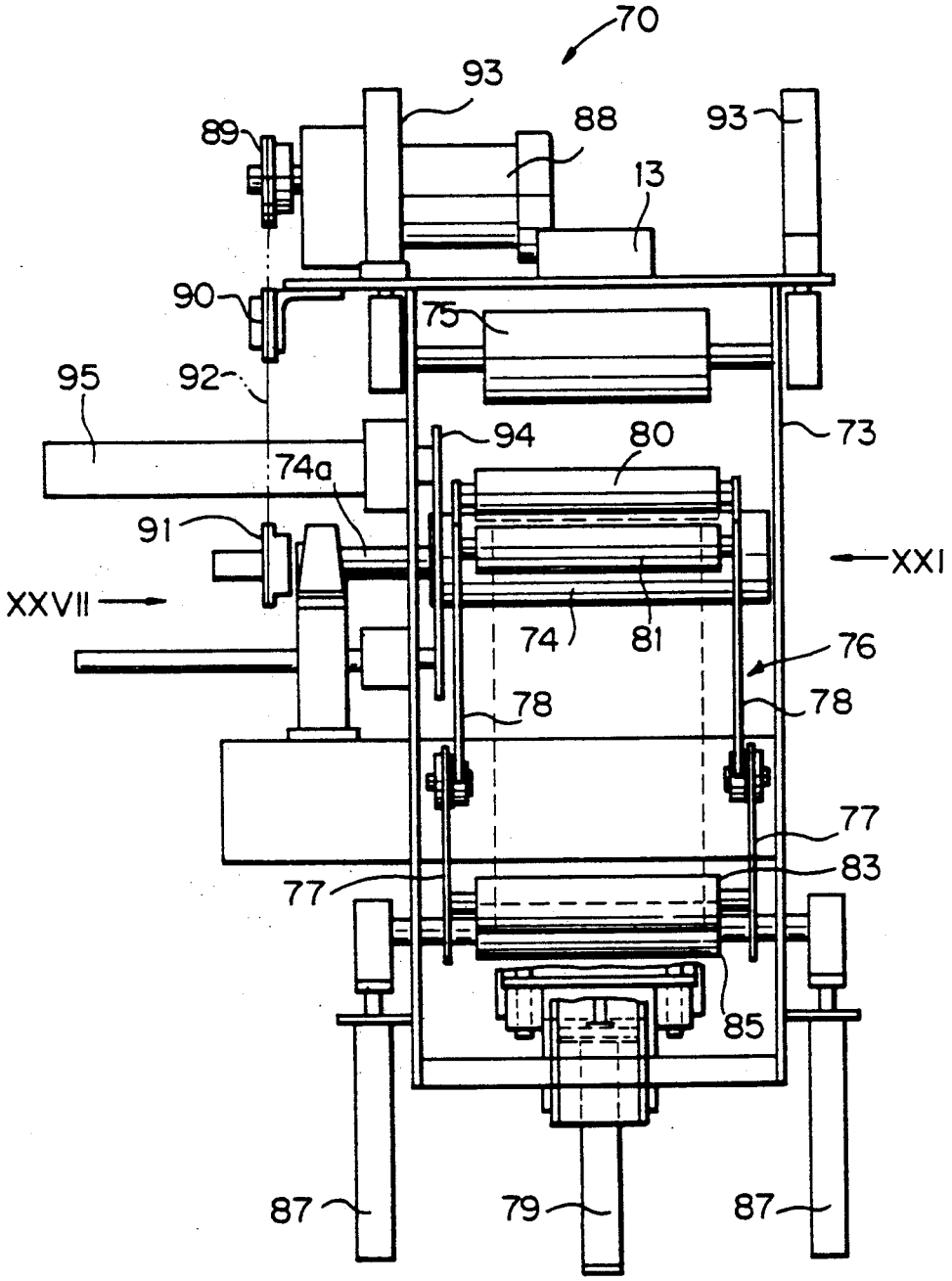
FIG. 22 is an end view of the used film winding unit of FIG. 21 with the pressure roller at a raised position, and viewed from the arrow XXII in FIGS. 21 and 23.
Figure 23:
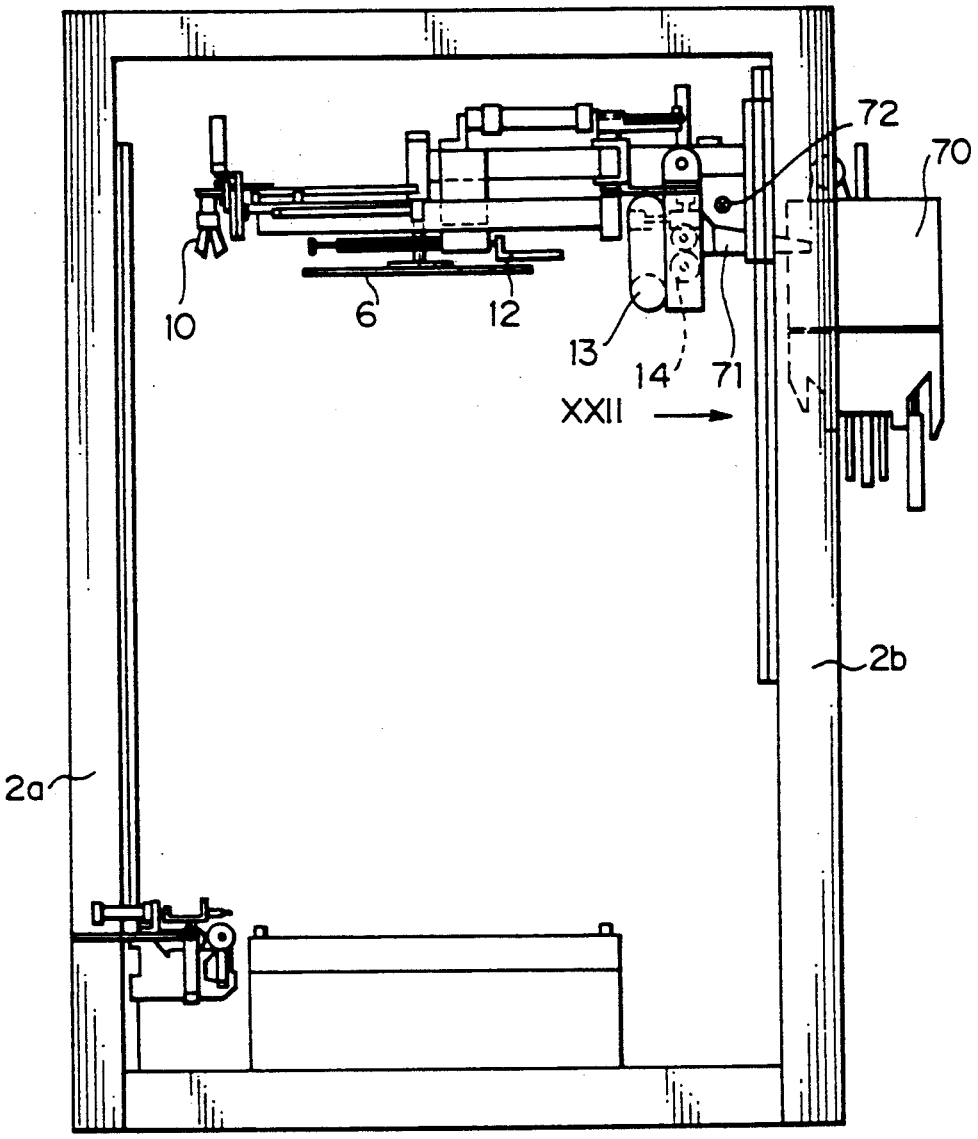
FIG. 23 is a side view of the used film winding unit of FIGS. 21 and 22 and the unwrapping apparatus.

FIGS. 21 to 26D show a used stretchable film winding unit 70 attached to the second or rear upright frame 2b of the unwrapping apparatus, as shown in FIG. 23. The used stretchable film winding unit 70 can be attached to another suitable stationary frame. The unwrapping apparatus has the ring-like collecting guide 13 and the discharge nip rollers 14, through which the used (separated from the load L) stretchable film 5 is discharged in a compacted belt-like shape, as previously described. A transferring guide 71 is arranged between the discharge nip rollers 14 and the used stretchable film winding unit 70 to transfer the used stretchable film 5 to the used stretchable film winding unit 70. There is a sensor 72 above the transferring guide 71 for detecting the transfer of the used stretchable film 5.

FIG. 21 is a side view of the unit 70 viewed from the arrow XXI in FIG. 22, and FIG. 22 is an end view of the unit 70 viewed from the arrow XXII in FIGS. 21 and 23. FIGS. 24A to 24D illustrate the operation of a mandrel and a discharge plate of FIGS. 21 and 22, FIGS. 25A and 25B are end views of the mandrel of FIGS. 21 and 22, and FIGS. 26A to 25E illustrate the operation of the unit 70.

As shown in FIGS. 21 and 22, the used film winding unit 70 comprises a main frame 73 including an opening 73a at one side thereof and a mandrel 74 extending horizontally and perpendicular to a line interconnecting the first and second upright frames 2a and 2b and perpendicular to the opening 73a such that a roll of the stretchable film 5 can be discharged from the opening 73a. A pressure roller 75 is arranged parallel to and above the mandrel 74; the pressure roller 75 being urged to and brought into contact with the mandrel 74 to rotate there with. A support belt 84 is brought into contact with a portion of the mandrel 74 on the opposite side of the pressure roller 75 to rotate with the mandrel 74, and a discharge plate 94 is arranged on one end of the mandrel 74 so as to travel along the length of the mandrel 74 to push and remove the roll of the stretchable film 5 wound on the mandrel 74 from the mandrel 74. The mandrel 74 has a variable diameter, so that the stretchable film 5 is wound on the mandrel 74 with a large diameter, and when the roll of the stretchable film 5 is pushed by the discharge plate 94, the diameter of the mandrel 74 attains a small diameter.

As shown in FIGS. 24A to 25B, the mandrel 74 comprises a support shaft 74a, an inner shaft 74b connected to the support shaft 74a, and an outer split sleeve 74c comprising four circumferentially spaced quarter cylindrical sections about the inner shaft 74b and covered by a slidable plastic layer 74d. These four quarter cylindrical sections of the outer split sleeve 74c are interconnected by elastic O-rings 74e. The outer split sleeve 74c has a radial flange 74f at one end thereof against which the discharge plate 94 abuts.

The inner shaft 74b has tapered outer surface portions 74g and the outer split sleeve 74c has correspondingly tapered inner surface portions 74h. The outer split sleeve 74c is axially slidable relative to the inner shaft 74b with the tapered inner surface portions 74h engaging with the tapered outer surface portions 74g so that when the outer split sleeve 74c is at the left position it provides a large diameter and when the outer split sleeve 74c is moved to the right position it provides a small diameter. The inner shaft 74b has outwardly projecting pins 74i and the outer split sleeve 74c has correspondingly recessed grooves 74j for axially guiding the outer split sleeve 74c along the inner shaft 74b. In addition, the inner shaft 74b has a stopper 74k at one end thereof opposite the radial flange 74f of the outer split sleeve 74c to restrict the movement of the outer split sleeve 74c. Also, the outer split sleeve 74c has lateral grooves 74p on the outer peripheral surface thereof, and a layer of plastic material having a good slidable properties may be coated on the outer peripheral surface of the outer split sleeve 74c.

As shown in FIGS. 21 and 22, the mandrel 74 (the support shaft 74a) is connected for rotation to an electric motor 88 via sprockets 89 to 91 and a chain 92. The discharge plate 94 is actuated by a pneumatic cylinder 95. The pressure roller 75 is not driven but urged to the mandrel 74 by pneumatic cylinders 93 so as to rotate with the mandrel 74. The support belt 84 embracing the mandrel 74 from below is carried in a support belt unit 76 including a belt frame 77, brackets 78 fixed to the belt frame 77 and pneumatic cylinders 79 connected to the belt frame 77 for upwardly and downwardly moving the belt frame 77. The support belt 84 is passed around guide rollers 80 to 83 rotatably attached to the brackets 78 and the belt frame 77. The support belt 84 is engaged with a tension roller 85 that is guided along a guider 86 and actuated by pneumatic cylinders 87 fixed to the belt frame 77.

Also, a heatsealer roller 96 is provided parallel to the mandrel 74 and supported by a pneumatic cylinder 97 for movement toward and away from the mandrel 74 so as to join together plural layers of the stretchable film 5 wound around the mandrel 5.

During operation of the used film winding unit 70, the used stretchable film 5 in a compacted belt-like shape discharged from the ring-like collecting guide 13 and the discharge nip rollers 14 is transferred to the used stretchable film winding unit 70 through the transferring guide 71. The sensor 72 above the transferring guide 71 detects the transfer of the used stretchable film 5 and activates the motor 88 to rotate the mandrel 74.

Figure 26A:
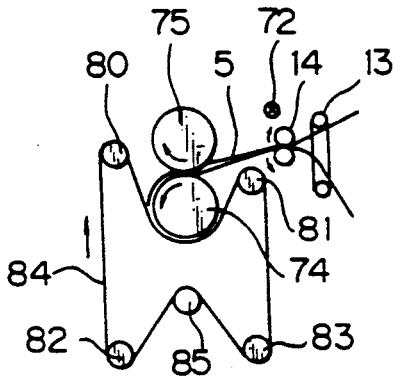
FIGS. 26A to 26E are diagrammatic views illustrating the operation of the used film winding unit of FIGS. 21 and 22.

As shown in FIG. 26A, the pressure roller 75 is urged from above to the mandrel 74 by the pneumatic cylinders 93, and the support belt 84 is urged from below to the mandrel 74 by the tension roller 85 with the support belt unit 76 raised by the pneumatic cylinders 87. The stretchable film 5 in belt-like form is introduced into the gap between the mandrel 74 and the pressure roller 75 to be compressed flat and further introduced into the gap between the mandrel 74 and the support belt 84 to thereby be wound around the mandrel 74 into a roll of stretchable film 5. At the beginning of the winding, the lateral grooves 74p of the outer split sleeve 74c of the mandrel 74 serves to bite therein the leading edge of the stretchable film 5 with the cooperation of the pressure roller 75.

Figure 26B:
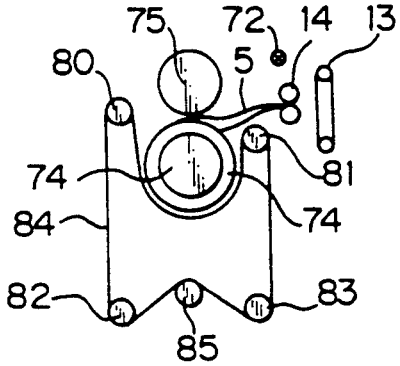
Figure 26C:
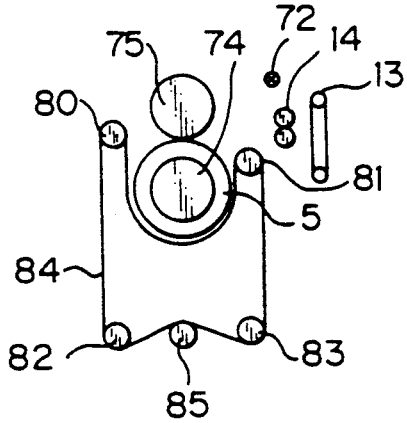

As shown in FIGS. 26B and 26C, as the winding of the stretchable film 5 advances, tension is applied to the stretchable film 5 between the mandrel 74 and the discharge nip rollers 14 since the circumference of the wound stretchable film 5 per revolution of the mandrel 74 increases, resulting in the stretchable film 5 urging the mandrel 74 and being tightly wound. As the diameter of the wound stretchable film 5 increases, the compression roller 75 is urged upwards and the portion of the support belt 84 around the mandrel 74 is urged downwards with the corresponding downward movement of the tension roller 85 along the guider 86 to compensate the length of the support belt 84.

Figure 26D:
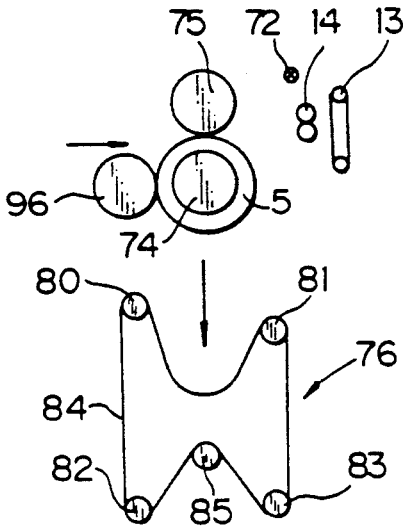

When a predetermined time passes after the sensor 72 above the transferring guide 71 has detected the trailing edge of the stretchable film 5, the pneumatic cylinders 79 are actuated to lower the belt frame 77 so that all the components of the support belt unit 76 are lowered, as shown in FIG. 26D. The motor 88 with the mandrel 74 is further rotated and the heatsealer roller 96 is moved toward the mandrel 74 with the actuation of the pneumatic cylinder 97 to join together plural layers of stretchable film 5 wound around the mandrel 5 to prevent the winding end portion of the roll of stretchable film 5 from loosening. Note, it is necessary to heatseal the winding end portion of the roll of the stretchable film 5 if the stretchable film 5 is of not-cling type but it is not necessary to heatseal the stretchable film 5 if it is of cling type.

Figure 26E:
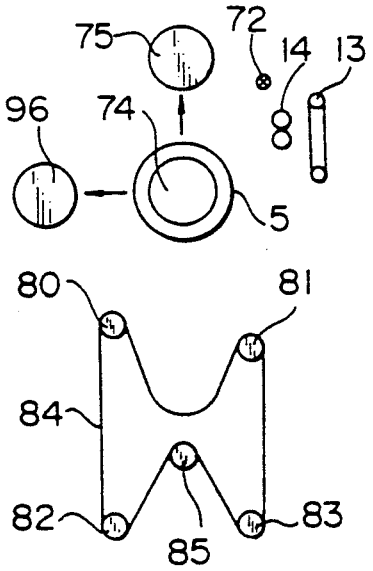

Then, as shown in FIG. 26E, the compression roller 75 is raised with the actuation of the pneumatic cylinder 93 and the heatsealer roller 96 is moved away from the mandrel 74 with the actuation of the pneumatic cylinder 97. The motor 88 with the mandrel 74 is stopped.

Figure 24A:
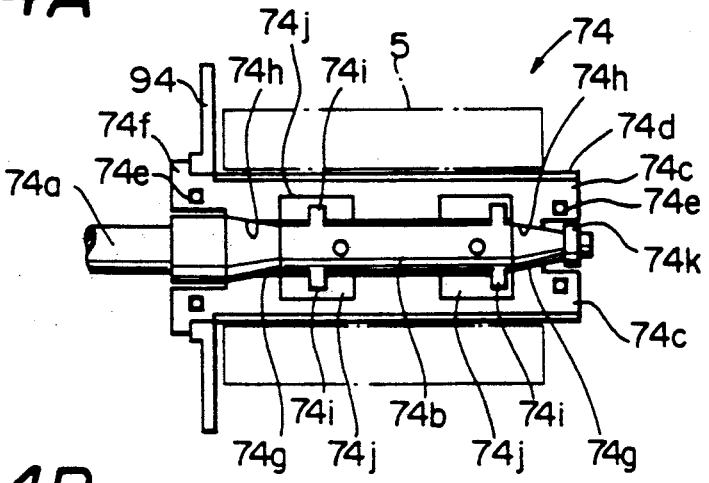
FIG. 24A to 24D are cross-sectional views illustrating the operation of a mandrel and a discharge plate of FIGS. 21 and 22.
Figure 24B:
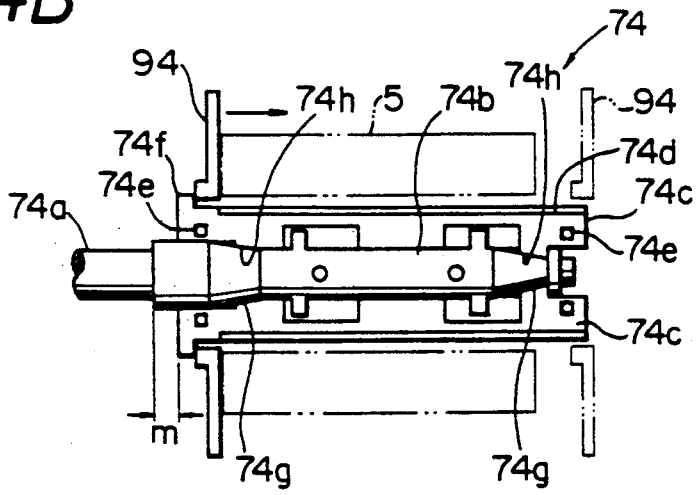
Figure 24C:
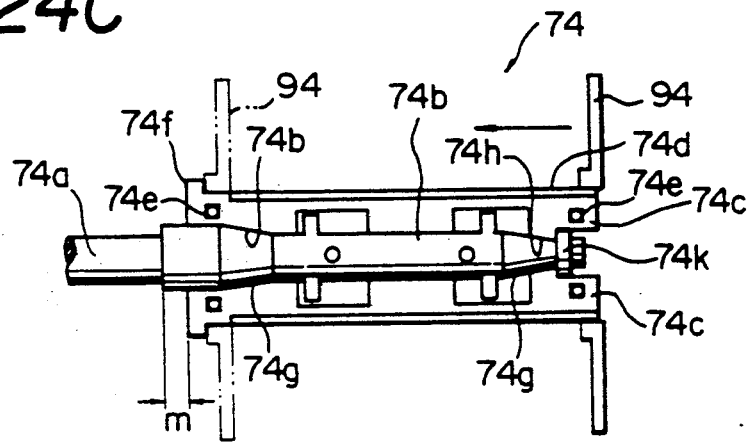

FIG. 24A is a side cross-sectional view of the mandrel 74 in the condition of FIG. 26E. The discharge plate 94, which is initially located on the flange 74*f* at the left end of the mandrel 74, is then moved to the right with the actuation of the pneumatic cylinder 95 so as to push the stretchable film 5, as shown in FIGS. 24A and 24B. As described above, the stretchable film 5 is wound around the mandrel 74 under tension and thereby compresses the mandrel 74, so that when the discharge plate 94 pushes the stretchable film 5, the stretchable film 5 is not released from the outer split sleeve 74*c* but moves with the outer split sleeve 74*c* to the right, and when the outer split sleeve 74*c* is moved to the right by the distance m, that is, when the outer split sleeve 74*c* is moved relative to the inner shaft 74*b* along the correspondingly tapered outer and inner surface portions 74*g* and 74*h* until the outer split sleeve 74*c* abuts against the stopper 74*k* at the right end of the inner shaft 74*b*, the diameter of the outer split sleeve 74*c* changes from a large diameter of FIG. 25A to a small diameter of FIG. 25B. Accordingly, the stretchable film 5 can be easily released from the outer split sleeve 74*c* along the slidable plastic layer 74*d* by further movement of the discharge plate 94 to the position shown by the semi-broken line in FIG. 24B and by the solid line in FIG. 24C, and the roll of stretchable film 5 is discharged from the opening 73*a* in the main frame 73 along the mandrel 74.

Figure 24D:
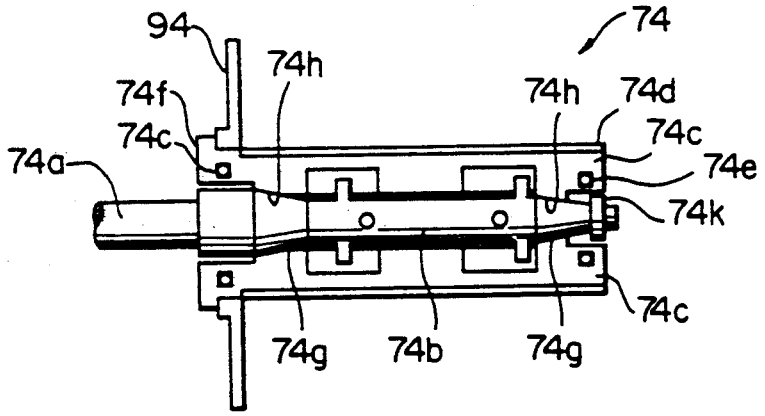
Figure 25A:
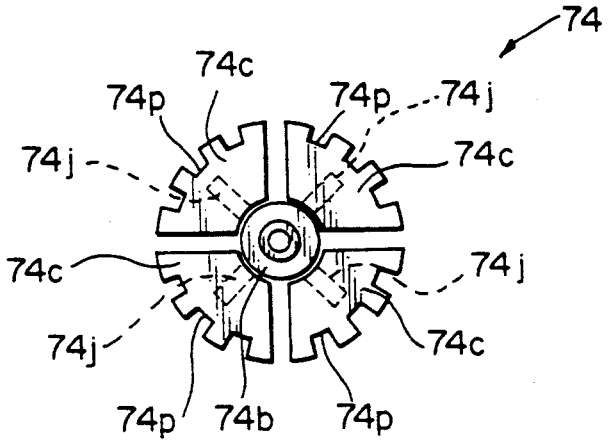
FIGS. 25A and 25B are end views of the mandrel of FIGS. 21 and 22.
Figure 25B:
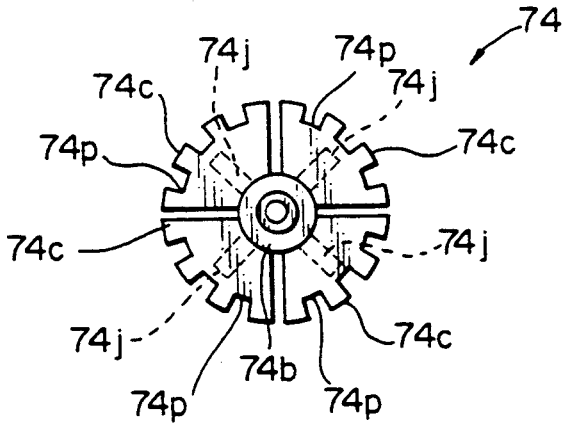

The discharge plate 94 is then returned from the right discharge position to the left position to abut against the flange 74*f* of the outer split sleeve 74*c* and further to the initial left position, thereby pushing the outer split sleeve 74*c* to its initial position, in which it has a large diameter, as shown in FIG. 24D. The compression roller 75 and the support belt unit 76 are then returned to urge the mandrel 74 with the actuation of the pneumatic cylinders 93 and 79, as shown in FIG. 26A. The belt-like stretchable films may be discharged one after another from the discharge nip rollers 14 and the cycle is repeated.

The used film winding unit 70 can be used with an unwrapping apparatus other than that shown in FIG. 1. In this case, the collecting guide 13 and the discharge nip roller 14 are preferably added to such an unwrapping apparatus. Also, it is possible to use a type of mandrel other than the mandrel 74, such as a mandrel having a diameter variable with the use of pneumatic pressure or other known expansion type mandrels.

FIGS. 27 to 32D show a used stretchable film wrapping unit 100 adapted for use with the unwrapping apparatus of FIG. 1 and the used film winding unit 70 of FIG. 21.

Figure 28:
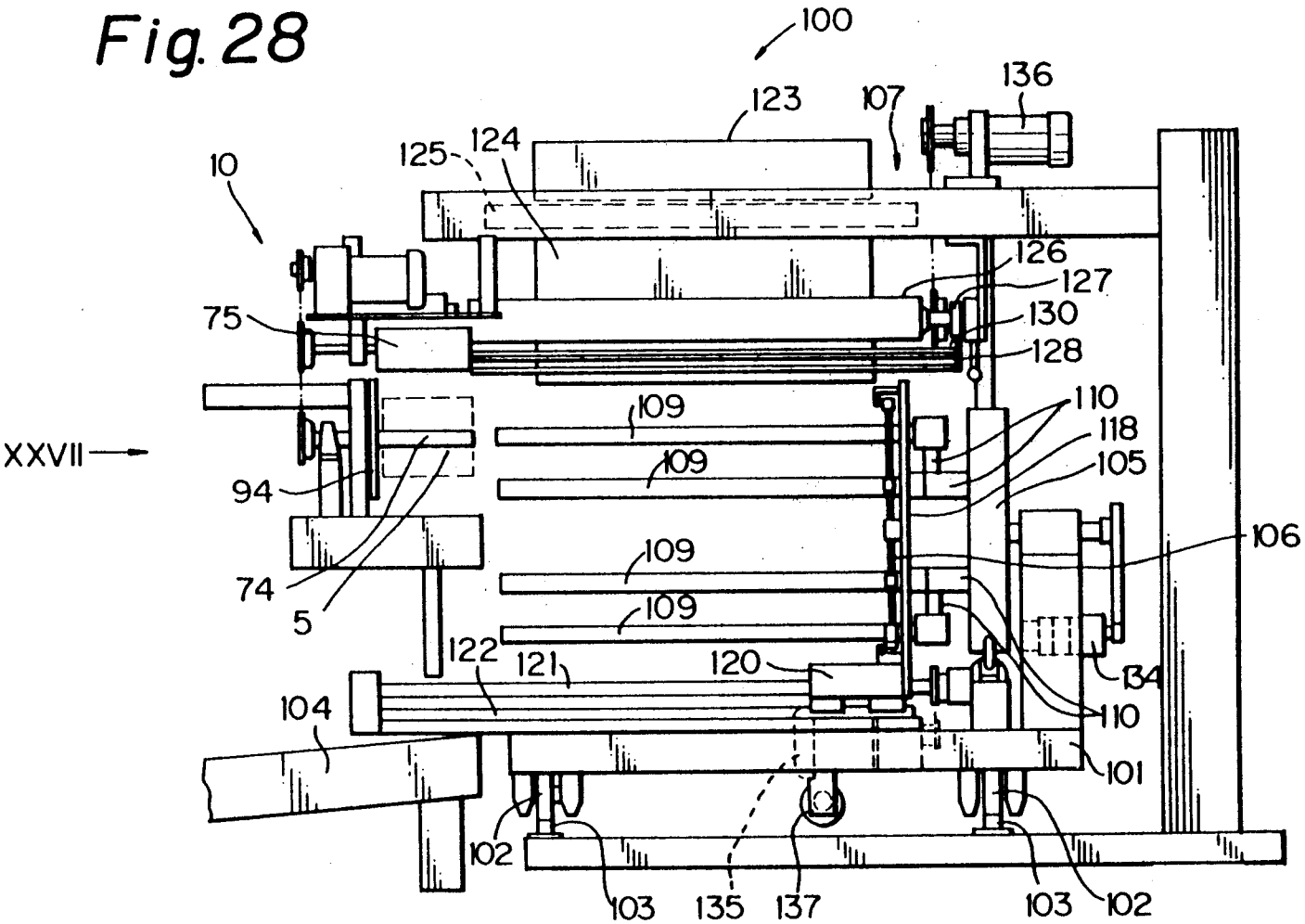
FIG. 28 is a side view of the used film wrapping unit, viewed from the arrow XXVIII in FIG. 27.
Figure 29A:
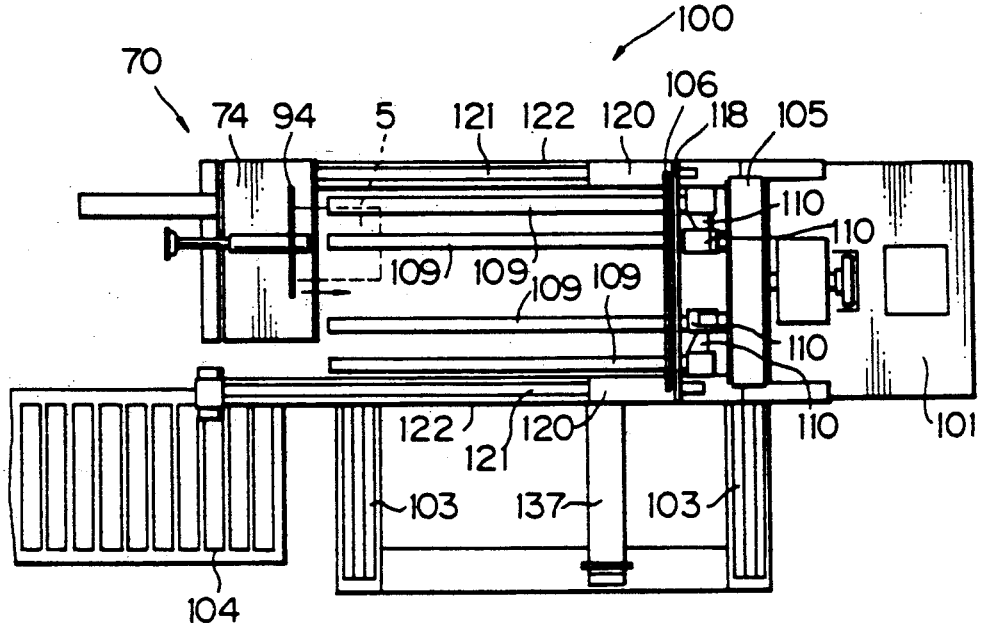
FIGS. 29A and 29B are plan views of the used film wrapping unit of FIGS. 27 and 28.
Figure 29B:
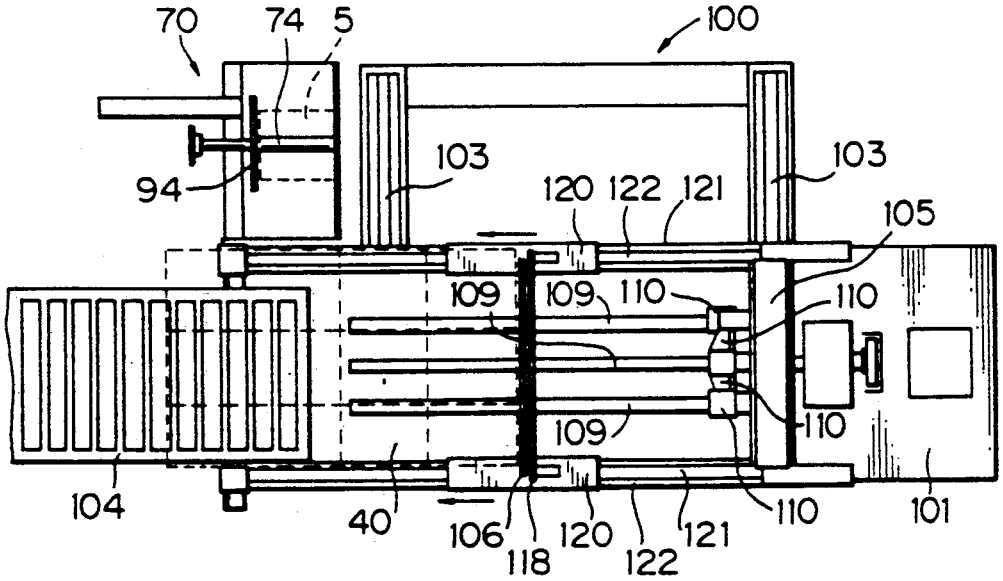

As shown in FIGS. 29A and 29B, the used film wrapping unit 100 is arranged on the side of the opening 73*a* in the main frame 73 of the used film winding unit 70, and comprises a plurality of (four in the embodiment) mandrels 109 carried by a rotatable turret 105 arranged on the side of the mandrels 109 remote from the used film winding unit 70 so that one of the mandrels 109 is brought into alignment with the mandrel 74 of the used film winding unit 70 so that the roll of the stretchable film 5 can be transferred from the mandrel 74 to the mandrel 109. Each of the mandrels 109 has sufficient length to receive a plurality of rolls of the stretchable film 5. The turret 105 is operatively connected to an electric motor 134 (FIG. 28) that is controlled by an appropriate control means (not shown) so that the turret 105 is stepwise rotated at an angle of 90 degrees, or 360 degrees (or multiple times of 90 degrees).

Figure 27:
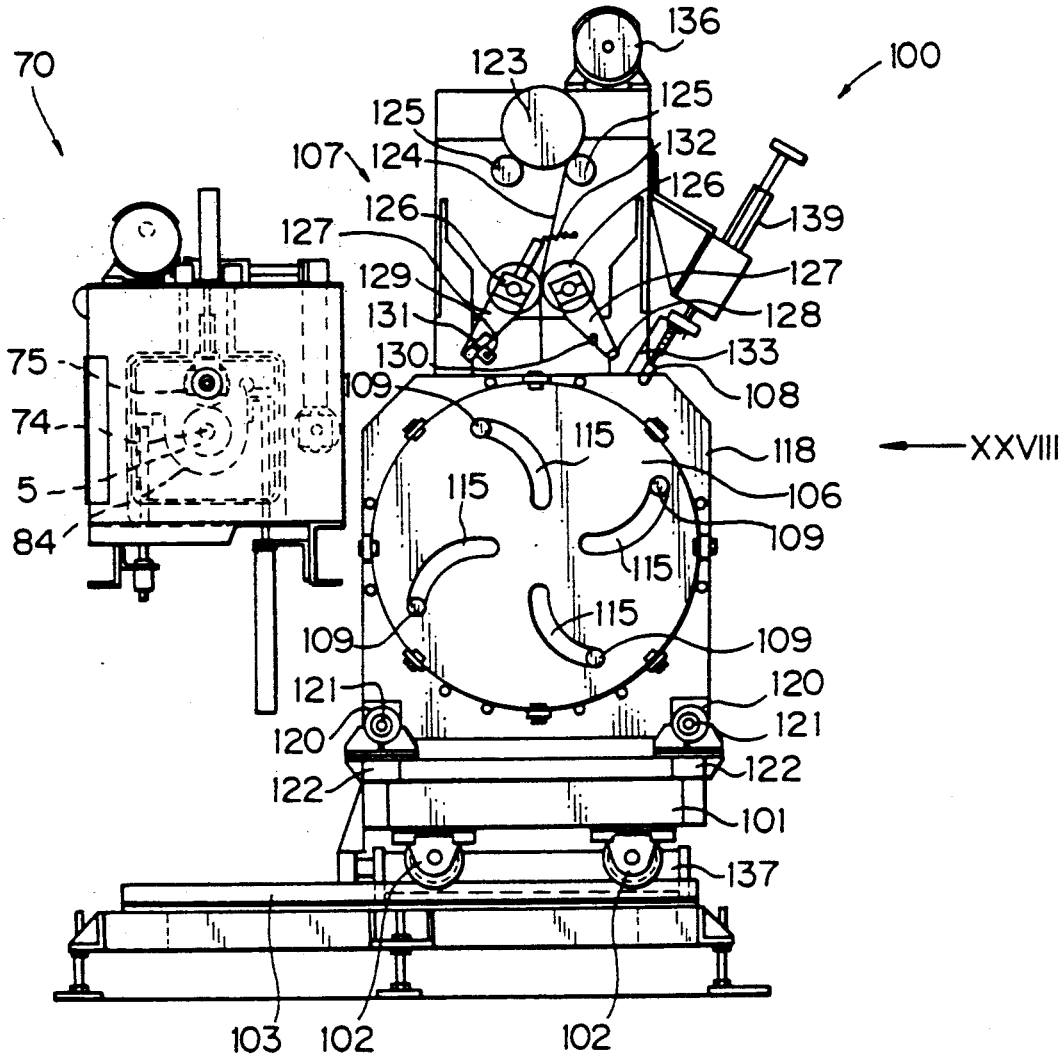
FIG. 27 is a side view of a used film wrapping unit adapted for use with the unwrapping apparatus of FIG. 1 and the used stretchable film winding unit of FIGS. 21 and 22, for example.

Referring to FIGS. 27 and 28, the used film wrapping unit 100 comprises a unit base 101 that supports turret 105 with the mandrels 109 and is displaceably supported on a horizontal rail 103 via caster wheels 102. The unit base 101 is moved transversely of the mandrels 109 between a first position in which the turret 105 with the mandrels 109 faces the used film winding unit 70 (FIG. 29A) and a second position in which the turret 105 with the mandrels 109 faces an inclined roller conveyor 104 (FIG. 29B) by a pneumatic cylinder 137. The movable unit base 101 also supports most components of the used film wrapping unit 100, described below.

The used film wrapping unit 100 comprises a discharge plate 106 having slots 115 for passing the mandrels 109 therethrough, a supply device 107 of a wrapping film 124 for wrapping the rolls of the stretchable film 5 on the mandrels 109, and a heatsealer 108 to join together the plural layers of the wrapping film 124 wrapping the rolls of the stretchable film 5.

The discharge plate 106 is supported by a pusher plate 118 arranged parallel to and in front of the turret 105. The pusher plate 118 is displaceably supported on linear ways 122 extending parallel to the mandrels 109 and fixed to the unit base 101. Feed nuts 120 are fixed to the bottom of the pusher plate 118 and engaged by feed screws 121 extending parallel to the linear ways. An electric motor 135 is operatively connected to rotate the feed screws 121.

Figure 31:
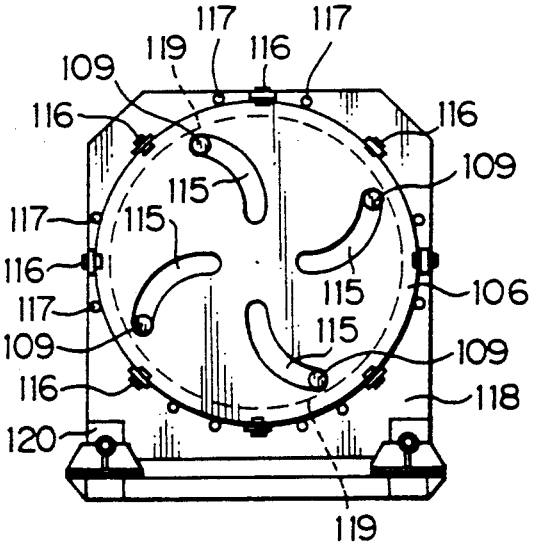
FIG. 31 is a front view of a discharge plate and a pusher plate of FIGS. 27 and 28.

As shown, particularly in FIG. 31, the pusher plate 118 has a large circular opening 119 that allows all the mandrels 109 to pass therethrough. The discharge plate 106 is a circular plate having a diameter slightly larger than that of the circular opening 119 and is concentrically arranged with the circular opening 119. The discharge plate 106 is rotatably supported to the pusher plate 118 by radially arranged support bearings 116 that engage with the front peripheral surface of the discharge plate 106 to retain the latter and radially arranged support rollers 117 that engage with the outer periphery of the discharge plate 106. The discharge plate 106 is thus freely rotatable relative to the pusher plate 118.

The discharge plate 106 has equiangularly arranged slots 115 to allow the mandrels 109 to pass therethrough, respectively. That is, the discharge plate 106 can move along the mandrels 109 by the operation of the feed screws 121. The slots 115 extend radially about the center of the discharge plate 106 and have an arcuate shape. The mandrels 109 can rotate about the center of the discharge plate 106 with the latter and can move radially of the discharge plate 106 along the arcuate slots 115, respectively.

Figure 30A:
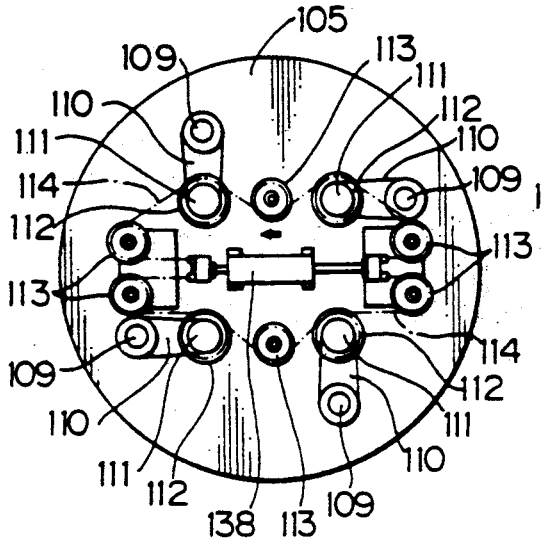
FIGS. 30A and 30B are front views of a turret of FIGS. 27 and 28.
Figure 30B:
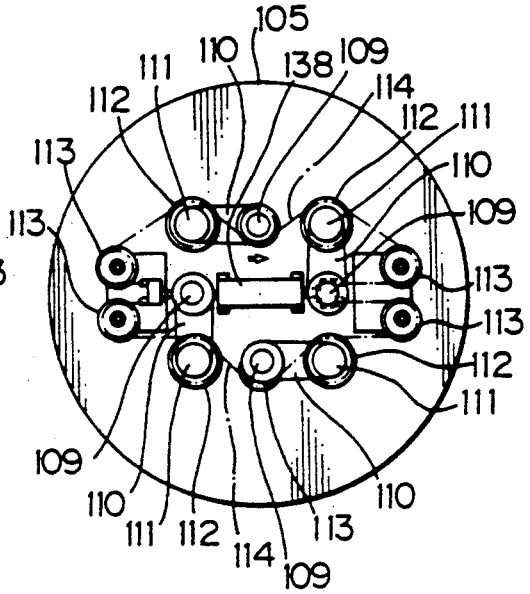

As shown in FIGS. 28, 30A and 30B, the mandrels 109 are equiangularly arranged and secured to the turret 105 via levers 110, respectively. Each lever 110 extends parallel to the turret 105 and has a support shaft 111 integral with the lever 110. The support shaft 111 is rotatably supported on the turret 105 and secures a sprocket wheel 112 thereon. A pneumatic cylinder 138 having an oppositely extending piston rod is arranged at the center of the turret 105. Two chains 114 are provided, each one extending around two sprocket wheels 112 and tensioners 113 with one end of the chain 114 being attached to one end of the oppositely extending piston rod of the pneumatic cylinder 138 and the other end of the chain 114 being attached to the other end of the piston rod. When the pneumatic cylinder 138 is operated so that the piston rod thereof is moved to the right in FIG. 30A, the chain 114 moves in the direction of the arrow to rotate the sprocket wheels 112 within 90 degrees of angle to thereby cause the levers 110 to rotate anticlockwise. Accordingly, the mandrels 109 move to a radially outer position along an arcuate path, which is defined in the slots 115. When the pneumatic cylinder 138 is operated reversely, the chain 114 moves in the direction of the arrow in FIG. 30B thereby causing the levers 110 to rotate clockwise. Accordingly, the mandrels 109 move to a radially inner position along the arcuate path. That is, each of the mandrels 109 is carried by the lever 110 to the turret 105 and displaceable along a predetermined path between a first position in which the mandrels 109 are standing in a first circle and a second position in which the mandrels 109 are standing in a second circle concentric with and smaller than the first circle.

As shown in FIGS. 27 and 28, the supply device 107 of the wrapping film 124 is arranged above the mandrels 109 carried by the turret 105 and comprises a pair of bearer rollers 125 on which a roll 123 of the wrapping film 124 rests. A brake is provided for braking the unwound wrapping film 124. A pair of feed rollers 126 are arranged below the bearer rollers 125 and actuated by a geared motor 136 to unwind the web of the wrapping film 124 from the roll 123 on the bearer rollers 125 so as to feed the same downwards through the feed rollers 126.

In addition, the feed rollers 126 have respective shafts to which arms 127 are mounted via ratchets, respectively. One of the arms 127 has at the bottom thereof a heat cutter 128 and the other arm 127 has at the bottom thereof an anvil 129. The arms 127 are normally in an open position shown in FIG. 27, by a spring 132 biasing one of the arms 127. One of the arms 127 also has a film holder 130 just above the heat cutter 128 and the other arm 127 also has a cushion 131 just above the anvil 129.

Figure 32A:
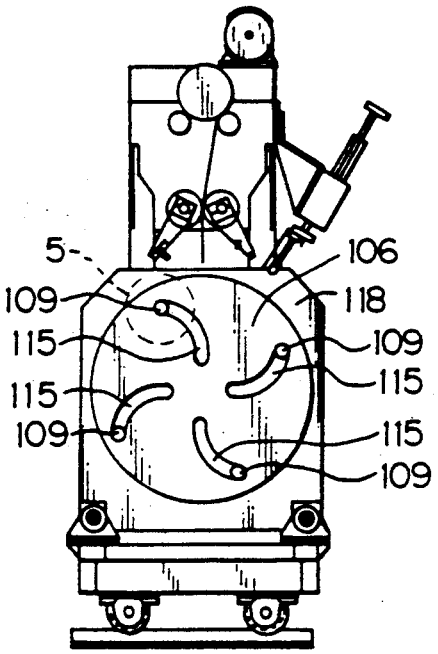
FIGS. 32A to 32D are front views of the used film wrapping unit of FIGS. 27 and 28.

When the motor 136 is rotated in one direction, the feed rollers 126 are rotated to feed the web of the wrapping film 124 downwards but the arms 127 remain in the position of FIG. 27 by the action of the ratchets. When the motor 136 is rotated in reverse, the feed rollers 126 are rotated in reverse and the arms 127 are closed, as shown in FIG. 32D, by the action of the ratchets. Accordingly, the web of the wrapping film 124 is cut between the heat cutter 128 and the anvil 129, and in this case, the severed end of the wrapping film 124 extending from the roll 123 is held and stabilized between the film holder 130 and the cushion 131.

The heatsealer 108 is carried by a bottom end of a piston rod of a pneumatic cylinder 139 that is mounted on a stationary frame member of the supply device 107. A film holding bar 138 is also carried by the piston rod of the pneumatic cylinder 139 and extends to a position near the heatsealer 108. The heatsealer 108 with the film holding bar 138 is advanced toward the rolls of the stretchable film 5 received in the mandrels 109 to heat seal together the stretchable film 5 and the wrapping film 124 to be wound around the rolls of the stretchable film 5 before wrapping or to heat seal the plural layers of the wrapping film 124 together after wrapping, as shown in FIG. 32C. The film holding bar 133 presses and stabilizes the wrapping film 124 upon heatsealing.

During the operation of the used film wrapping unit 100, the unit base 101 is first moved to the position of FIG. 29A, and one of the mandrels 109 is brought into alignment with the mandrel 74 of the used film winding unit 70. The discharge plate 94 of the used film winding unit 70 then pushes the roll of the stretchable film 5 onto the mandrel 109 of the used film wrapping unit 100, as shown in FIGS. 29A and 32A. The operation of the used film winding unit 70 is repeated until four rolls, for example, of the stretchable film 5 are received on the mandrel 109. Then the turret 105 is rotated with the actuation of the motor 134 at an angle of 90 degrees so that the next mandrel 109 is brought into alignment with the mandrel 74. Similarly, four rolls of the stretchable film 5 are then received on that mandrel 109. The turret 105 is then further rotated at an angle of 90 degrees and the third mandrel 109 receives four rolls of the stretchable film 5, and the fourth mandrel 109 also receives four rolls of the stretchable film 5. This is shown in FIG. 32B.

Figure 32B:
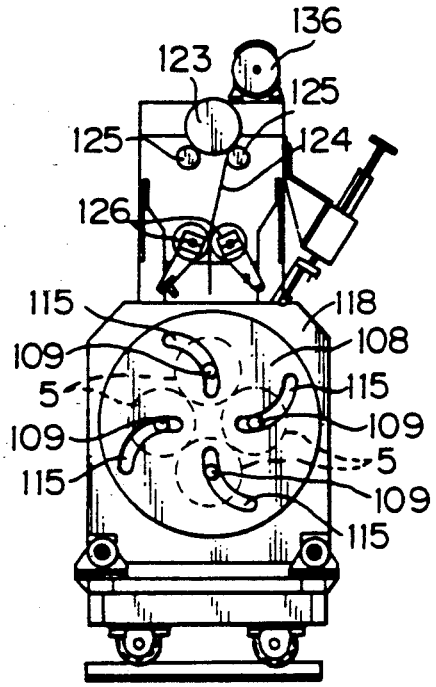
Figure 32C:
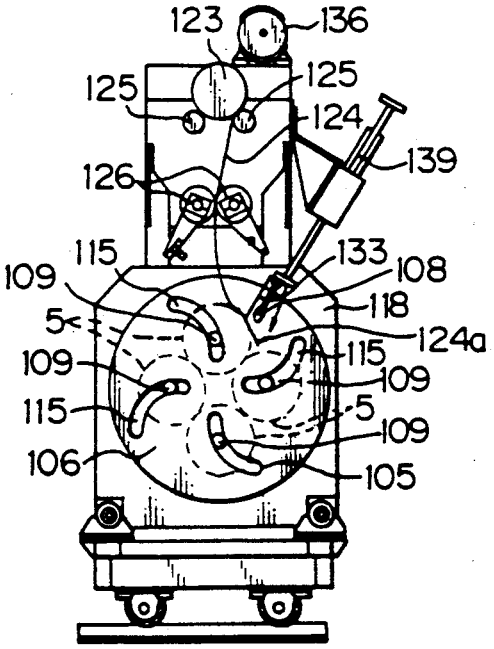
Figure 32D:
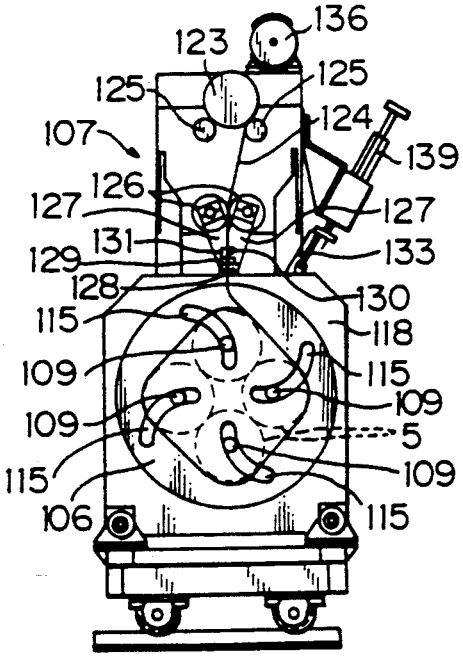

When the four mandrels 109 are fully loaded with the rolls of the stretchable film 5, the pneumatic cylinder 138 is actuated from the position of FIG. 30A to the position of FIG. 30B, so that the mandrels 109 are moved inwardly of the turret 105, as shown in FIG. 32B. The motor 136 of the wrapping film supply device 107 is then rotated so that the feed rollers 126 are rotated to feed the web of the wrapping film 124 until the wrapping film 124 reaches the side surface of the uppermost mandrel 109 (see the leading edge portion 124*a* of the wrapping film 124 in FIG. 32C). Note, the discharging plate 106 rotates relative to the stationary pusher plate 118, following the rotating mandrels 109.

The heatsealer 108 is then advanced with the actuation of the pneumatic cylinder 139 so that the hanging wrapping film 124 is joined to the surface of the rolls of the stretchable film 5 held on the uppermost mandrel 109. After the heatsealer 108 retreats, the turret 105 is rotated at an angle of 360 degrees so that the wrapping film 124 encircles the four rows of the rolls of the stretchable film 5. Then the heatsealer 108 is again advanced to heat seal the layers of the wrapping film, i.e., the leading edge portion 124*a* and the trailing edge portion of the wrapping film 124 are heat sealed together to complete a package. It is, of course, possible to rotate the turret 105 two or three turns to encircle the rolls of the stretchable film 5 twice or thrice. The motor 136 is then rotated in reverse so that the feed rollers 126 are rotated in reverse and the arms 127 are closed, as shown in FIG. 32D. The wrapping film 124 is cut between the heat cutter 128 and the anvil 129. If the length of a portion of the wrapping film 124 between the severed end and the sealed point is long, it is possible to further rotate the turret 105 at an angle of 90 degrees and further heatseal the excess portion.

The unit base 101 is then moved to the position of FIG. 29B with the actuation of the pneumatic cylinder 137, where the mandrels 109 face the inclined roller conveyor 104. This operation can be carried out at a prior stage after the four mandrels 109 are loaded with the rolls of the stretchable film 5. The pusher plate 118 with the discharging plate 106 is then advanced toward the inclined roller conveyor 104 on the linear way 122 along the length of the mandrels 109 with the actuation of the motor 135 rotating the feed screw 121 relative to the feed nut 120 pushing the package of the stretchable film 5 by the discharging plate 106, and thus, removing the rolls of the stretchable film 5 from the mandrels 109. Accordingly, the package of the stretchable film 5 is discharged to the inclined roller conveyor 104, from which the package of the stretchable film 5 is further conveyed to an appropriate box or the like for recycling of the stretchable film 5 and the wrapping film 124. The elements are returned to their initial position and the cycle is repeated.

We claim:

1. An unwrapping apparatus for unwrapping a load comprised of a pallet, a plurality of articles palletized on the pallet and a stretchable film wrapping the articles and the pallet together; said unwrapping apparatus comprising:

first and second upright frames arranged in a spaced relationship;

means for conveying a load to be unwrapped at a position between the first and the second upright frames;

lower gripper means arranged on or near the first upright frame for gripping a lower edge of a stretchable film of a load to be unwrapped;

a cutter unit arranged on the first upright frame for upward and downward movement along the first upright frame for vertically cutting the stretchable film;

a carriage arranged on the second upright frame for upward and downward movement along the second upright frame and having pressing means to press the top of the load to be unwrapped so as to stabilize the same while being unwrapped;

a pair of swing arms symmetrically arranged on either side of the pressing means with pivot ends on the side of the second upright frame and free ends on the side of the first upright frame;

an upper gripper arranged on the free end of each of the swing arms for gripping an upper edge of the stretchable film of the load, whereby the stretchable film that is cut by the cutter unit and gripped by the upper grippers is spread and separated from the load during a swing motion of the swing arms; and a pair of auxiliary film separating means operable in synchronism with the movement of the swing arms for engagement with corner portions of the stretchable film on the side of the second upright frame to separate the stretchable film from the corner portions of the load.

2. An unwrapping apparatus according to claim 1, wherein the lower gripper means comprises two lower grippers arranged on the first upright frame in a horizontally side by side relationship for gripping a lower edge of the stretchable film on the load to be unwrapped; each of the lower grippers being movable toward and away from the load;

the cutter unit is arranged on the first upright frame between the two lower grippers for upward and downward movement along the first upright frame; the cutter unit having two pairs of pinch rollers with one of each pair of pinch rollers positionable on the exterior side of the stretchable film and the other on the interior side of the stretchable film to grip the stretchable film therebetween, and cutting means arranged between the two pairs of pinch rollers for cutting the stretchable film; and the carriage including a support frame extending perpendicular to a line interconnecting the first and the second upright frames; the support frame carrying the swing arms and the auxiliary film separating means.

3. An unwrapping apparatus according to claim 2, wherein the cutting means comprises an electric heat cutter.

4. An unwrapping apparatus according to claim 2, wherein the auxiliary film separating means are pivotally carried by the support frame of the carriage at positions on or near the respective pivot ends of the swing arms.

5. An unwrapping apparatus according to claim 4, wherein the upper grippers are movable upwards and downwards relative to and toward and away from the respective swing arms, and wherein the swing arms are initially arranged so that the distance between the free ends thereof is smaller than the distance between the pivot ends thereof, and then swung outwardly about the respective pivot ends simultaneously with the forward movement of the upper grippers by extending the swing arms after the stretchable film is cut, to thereby maintain tension on the stretchable film while the stretchable film is separated from the load.

6. An unwrapping apparatus according to claim 5, wherein the upper grippers are further movably arranged so as to horizontally and outwardly rotate about the respective free ends of the swing arms to a position in which the upper grippers are generally parallel to the swing arms when the latter are fully swung.

7. An unwrapping apparatus according to claim 5, wherein the movement of the auxiliary film separating means is completed before the movement of the swing arms is completed.

8. An unwrapping apparatus according to claim 7, wherein the movement of the auxiliary film separating means is started after the movement of the swing arms is started.

9. An unwrapping apparatus according to claim 8, wherein each of the auxiliary film separating means comprises an auxiliary swing arm having a length shorter than that of the swing arms, and a vertically retractable pin carried by the auxiliary swing arm.

10. An unwrapping apparatus according to claim 9, wherein the auxiliary swing arm is carried by the support frame of the carriage via a rotary actuator, and the retractable pin is carried by the auxiliary swing arm via a vertical pneumatic cylinder.

11. An unwrapping apparatus according to claim 10, wherein the rotary actuator comprises a rotary pneumatic actuator operable within a predetermined angular range of at least 90 degrees.

12. An unwrapping apparatus according to claim 1, wherein the swing arm is actuated by a pneumatic cylinder.

13. An unwrapping apparatus according to claim 1, wherein the swing arm is actuated by a servo-motor.

14. An unwrapping apparatus according to claim 2, wherein at least one of the pinch rollers of the cutter unit has a heatseal means incorporated therein to join together plural layers of the stretchable film.

15. An unwrapping apparatus according to claim 14, wherein the heatsealing means is incorporated in the nip roller so as to be positioned on the exterior side of the stretchable film.

16. An unwrapping apparatus according to claim 15, wherein the heatsealing means comprises an electrical resistance wire wound around the nip roller, a slip ring means connected to the electrical resistance wire, and power supply contact means for the slip ring means, and an electrically insulating layer covering the electrical resistance wire.

17. An unwrapping apparatus according to claim 1, wherein the carriage further includes a heatsealing means for movement upwards and downwards, and toward and away from the load to join together plural layers of the stretchable film and a top cover if provided.

18. An unwrapping apparatus according to claim 1, wherein at least one position correcting means is provided for engagement with an upper edge of the stretch-wrapped load to correct the position of the load in relation to the position of the upper grippers.

19. An unwrapping apparatus according to claim 18, wherein the position correcting means comprises a correcting guide located above the load to be unwrapped; the correcting guide being capable of moving from a first horizontal position on the outside of the load to a second downwardly tilted position toward the load to thereby engage with an upper edge of the stretchable film.

20. An unwrapping apparatus according to claim 18, wherein the position correcting means comprises at least one pair of correcting guides located above the load to be unwrapped, one of each pair of the correcting guides being located on the side of the first upright frame and the other guide on the side of the second upright frame, and the correcting guides being capable of moving from a first horizontal position on the outside of the load to a second downwardly tilted position toward the load to thereby engage with an upper edge of the stretch-wrapped load.

21. An unwrapping apparatus according to claim 20, wherein the correcting guide located on the side of the first upright is capable of moving toward and away from the load.

22. An unwrapping apparatus according to claim 18, wherein the position correcting means comprises a correcting guide located above the load to be unwrapped and on the side of the first upright frame, the correcting guide being capable of moving from a first horizontal position on the outside of the load to a second downwardly tilted position toward the load to thereby engage with an upper edge of the stretch-wrapped load and a heatsealing means arranged on the side of the second upright frame and capable of moving toward and away from the load to engage with the load and to join together plural layers of the stretchable film and a top cover if provided.

23. An unwrapping apparatus according to claim 18, wherein the pressing means is a platen mounted to the carriage and the position correcting means is attached to the platen.

24. An unwrapping apparatus according to claim 23, wherein the platen is H-shaped.

25. An unwrapping apparatus according to claim 1, wherein the apparatus further includes a ring-like collecting guide for collectively guiding the stretchable film that is cut and separated from the load, a pusher pushing the stretchable film into the collecting guide, and a pair of discharge nip rollers arranged on the outlet side of the collecting guide to continuously compress and discharge the stretchable film pushed into the collecting guide.

26. An unwrapping apparatus according to claim 25, wherein the apparatus further includes a used film winding unit for winding the stretchable film that is separated from the load by the upper gripper and the swing arms and discharged by the discharge nip rollers into a roll; the used film winding unit comprising a mandrel for winding the stretchable film thereon, a pressure roller urged to and brought in contact with the mandrel to rotate therewith, a support belt brought in contact with a portion of the mandrel on the opposite side of the pressure roller to rotate with the mandrel, and a discharge plate capable of moving along the length of the mandrel to push and remove the roll of the stretchable film wound on the mandrel from the mandrel.

27. An unwrapping apparatus according to claim 1, wherein the apparatus further includes a used film winding unit for winding the stretchable film that is separated from the load by the upper gripper and the swing arms into a roll; the used film winding unit comprising a mandrel for winding the stretchable film thereon, a pressure roller urged to and brought into contact with the mandrel to rotate therewith, a support belt brought into contact with a portion of the mandrel on the opposite side of the pressure roller to rotate with the mandrel, and a discharge plate capable of moving along the length of the mandrel to push and remove the roll of the stretchable film wound on the mandrel from the mandrel.

28. An unwrapping apparatus according to claim 27, wherein the mandrel has an outer diameter that varies from a first large diameter to a second small diameter; the roll of the stretchable film being wound on the mandrel in the condition of the first large diameter and removed by the discharge plate in the condition of the second small diameter.

29. An unwrapping apparatus according to claim 28, wherein the mandrel comprises an inner shaft and an outer split sleeve having a plurality of circumferentially spaced sections about the inner shaft and interconnected by an elastic connecting means so that the outer diameter of the outer split sleeve is variable.

30. An unwrapping apparatus according to claim 29, wherein the inner shaft has a tapered outer surface and the outer split sleeve has a correspondingly tapered inner surface; the outer split sleeve being axially slidable relative to the inner shaft with the tapered inner surface engaging with the tapered outer surface so that when the discharge plate pushes the roll of the stretchable film in one direction, the outer split sleeve is moved due to the friction of the roll of the stretchable film on the outer split sleeve to vary the outer diameter of the outer split sleeve from a large value to a small value and to allow the roll of the stretchable film alone to be pushed relative to the outer split sleeve and the inner shaft.

31. An unwrapping apparatus according to claim 30, wherein a stopper is provided in the inner shaft to restrict the movement of the outer split sleeve in said one direction relative to the inner shaft.

32. An unwrapping apparatus according to claim 31, wherein a flange is provided in the outer split sleeve to engage with the discharge plate when the discharge plate is returned.

33. An unwrapping apparatus according to claim 32, wherein the outer split sleeve has a plurality of lateral grooves on its uneven outer peripheral surface, and a slidable layer is coated on the grooved outer peripheral surface.

34. An unwrapping apparatus according to claim 27, wherein a heatsealing means is provided to join together plural layers of the stretchable film.

35. An unwrapping apparatus according to claim 27, wherein the pressure roller is urged to the mandrel by a pneumatic cylinder.

36. An unwrapping apparatus according to claim 27, wherein the support belt is passed around a plurality of guide rollers and engaged with at least one tension roller; the support belt, the guide rollers and the tension roller being mounted or a common frame as a unit.

37. An unwrapping apparatus according to claim 26, wherein the apparatus further includes a used film wrapping unit for wrapping the stretchable film that is wound by the used film winding unit into a roll and discharged by the discharge plate; the used film wrapping unit comprises a base, a rotatable turret on the base, a plurality of mandrels extending from the turret to receive the rolls of the stretchable film, respectively, a pusher plate supporting a discharge plate having slots for protruding mandrels therethrough and movable along the axis of the mandrels to push the rolls of the stretchable film on the mandrels to remove the rolls of the stretchable film from the mandrels, a supply of a wrapping film for wrapping the rolls of the stretchable film on the mandrels, and a heatsealer to join the plural layers of the wrapping film for wrapping the rolls of the stretchable film together.

38. An unwrapping apparatus according to claim 1, wherein the apparatus further includes a used film wrapping unit for wrapping the stretchable film that is separated from the load by the upper grippers and the swing arms and discharged in the shape of a roll by a discharge means; the used film wrapping unit comprises a base, a rotatable turret on the base, a plurality of mandrels extending from the turret to receive the rolls of the stretchable film, respectively, a pusher plate supporting a discharge plate having slots for protruding the mandrels therethrough and movable axially of the mandrels to push the rolls of the stretchable film on the mandrels to remove the rolls of the stretchable film from the mandrels, a supply of a wrapping film for wrapping the rolls of the stretchable film on the mandrels, and a heatsealer to join the plural layers of the wrapping film for wrapping the rolls of the stretchable film together.

39. An unwrapping apparatus according to claim 38, wherein the base is movable between a first position in which one of the mandrels can receive a roll of the stretchable film from the discharge means and a second position in which the rolls of the stretchable film on the mandrels can be removed from the mandrels.

40. An unwrapping apparatus according to claim 39, wherein each of the mandrels is carried by a support means to the turret and displaceable along a predetermined path between a first position in which the mandrels are standing in a first circle and a second position in which the mandrels are standing in a second circle concentric with and smaller than the first circle, and each of the slots of the discharge plate has a shape corresponding to the predetermined path of the mandrel.

41. An unwrapping apparatus according to claim 40, wherein the support means comprises a lever having one end supporting each of the mandrels and a second end rotatably attached to the turret; the lever being rotatably actuated by a pneumatic cylinder via at least one sprocket and chain.

42. An unwrapping apparatus according to claim 41, wherein the pusher plate rotatably supports the discharge plate to allow the discharge plate to follow the rotation of the mandrel and is movable along the axis of the mandrels to remove the rolls of the stretchable film from the mandrels.

* * * * *